US005156945A

United States Patent [19]

Matsumoto et al.

[11] Patent Number: 5,156,945

[45] Date of Patent: Oct. 20, 1992

[54] SILVER HALIDE COLOR PHOTOGRAPHIC MATERIALS

[75] Inventors: Kazuhiko Matsumoto; Masakazu Morigaki; Shigeo Hirano; Satoshi Nagaoka, all of Kanagawa, Japan

[73] Assignee: Fuji Photo Film Co., Ltd., Kanagawa, Japan

[21] Appl. No.: 482,605

[22] Filed: Feb. 21, 1990

[30] Foreign Application Priority Data

Feb. 21, 1989 [JP] Japan ..... 1-40796

[51] Int. Cl.[5] ..... G03C 1/34

[52] U.S. Cl. ..... 430/523; 430/607; 430/612; 430/547; 430/551

[58] Field of Search ..... 430/551, 612, 607, 523, 430/547

[56] References Cited

U.S. PATENT DOCUMENTS

| | | | |
|---|---|---|---|
| 2,735,765 | 2/1956 | Loria et al. | 430/551 |
| 4,795,696 | 1/1989 | Sasaki et al. | 430/551 |
| 4,906,559 | 3/1990 | Nishijima et al. | 430/551 |
| 5,024,924 | 6/1991 | Naruse et al. | 430/551 |

*Primary Examiner*—Bowers, Jr.: Charles L.
*Assistant Examiner*—Janet C. Baxter
*Attorney, Agent, or Firm*—Sughrue, Mion, Zinn Macpeak & Seas

[57] ABSTRACT

A silver halide color photographic material comprising a support having thereon at least one silver halide emulsion layer, wherein the photosensitive material contains at least one compound represented by General Formula (I), and at least one type of compound represented by General Formula (II) or an organometallic complex which has copper, cobalt, nickel, palladium or platinum as the central metal and which has at least one bidentate organic ligand, wherein general Formula (I) has the following formula:

(I)

and general Formula (II) has the following formula:

$$R_{10}—W—R_{11} \quad \text{(II)}$$

wherein the variables are defined in the specification.

13 Claims, No Drawings

SILVER HALIDE COLOR PHOTOGRAPHIC MATERIALS

FIELD OF THE INVENTION

This invention concerns silver halide color photographic materials, and more precisely it concerns silver halide color photographic materials which have a good white base and gradation, and which also have excellent storage properties.

BACKGROUND OF THE INVENTION

Techniques for improving the white base and techniques for controlling gradation in silver halide photographic materials of the type in which a color forming coupler is included in a silver halide photographic emulsion and which are developed using a color developer such as p-phenylenediamine for example are important techniques which dominate picture quality. Methods in which various hydroquinones are used have long been known in connection with the improvement of the white base (the prevention of color fogging) in particular.

For example, the use of mono-(linear chain alkyl)hydroquinones has been disclosed in U.S. Pat. No. 2,728,659 and JP-A-49-106329, and the use of mono-(branched chain alkyl)hydroquinones has been disclosed in U.S. Pat. No. 3,700,453, West German Patent Laid Open 2,149,789, JP-A-50-156438 and JP-A-49-106329. (The term "JP-A" as used herein signifies an "unexamined published Japanese patent application".) On the other hand, di-(linear chain alkyl)-hydroquinones have been disclosed, for example, in U.S. Pat. Nos. 2,728,659 and 2,732,300, British Patents 752,146 and 1,086,208, and in *Chemical Abstracts,* Vol. 58, 6367h, and di-(branched chain alkyl)-hydroquinones have been disclosed in U.S. Pat. Nos. 3,700,453 and 2,732,300, British Patent 1,086,208, in the aforementioned *Chemical Abstract,* and in JP-A-50-156438.

The use of various anti-color fading agents is known as a means of improving the storage properties of a colored image. Typical examples of organic anti-color fading agents include hydroquinones, 6-hydroxychromans, 5-hydroxychromans, spirochromans, p-alkoxyphenols, hindered phenols such as bisphenols, gallic acid derivatives, methylenedioxybenzenes, aminophenols, aromatic or aliphatic amines, and ether and ester derivatives wherein the phenolic hydroxyl groups of these compounds have been silylated or alkylated. Furthermore, metal complexes, as typified by the (bis-salicylamidoxymato)nickel complex and the (bis-N,N-dialkyldithiocarbamato)nickel complex, are also known in this connection.

Typical examples of these anti-color fading agents have been disclosed on pages 401–440 of JP-A-62-215272. It is known that the intended purpose can be realized by co-emulsifying these compounds with the couplers, normally at a rate of from 5 to 100 percent by weight with respect to the corresponding color coupler, and adding them to the photosensitive layer.

The use of alkylhydroquinones as agents for preventing the occurrence of color impurity has also been disclosed in British Patents 558,258, 557,750 (corresponding to U.S. Pat. No. 2,360,290), 557,802, 731,301 (corresponding to U.S Pat. No. 2,701,197), 2,336,327, 2,403,721, 2,735,765 and 3,582,333, West German Patent Laid Open 2,505,016 (corresponding to JP-A-50-110337), JP-B-56-40816 and JP-B-56-21145. (The term "JP-B" as used herein signifies an "examined Japanese patent publication".)

In recent years, the required levels with respect to a good white base and gradation control have been increased. The use of compounds of comparatively low molecular weight from among the above mentioned hydroquinones has been suggested in this connection in JP-A-62-239153, JP-A-63-63033 and JP-A-63-80250, and these certainly provide a good white base. However, these compounds give rise to problems in that contamination of the development bath and deterioration of development bath performance occur, because these co npounds dissolve out of the photographic material into the color development bath during development processing in continuous processing.

Furthermore, when some of the 2,5-dialkylhydroquinones are used in color photographic materials, as disclosed in JP-B-56-21145, the colored images obtained, and especially the colored images which contain cyan dyes and yellow dyes, are known to have an inferior light resistance and fastness.

SUMMARY OF THE INVENTION

Hence, the present invention is intended to provide silver halide color photographic materials with which there is no contamination of the development bath, with which the occurrence of unwanted staining is prevented, and which have good colored image storage properties.

More specifically, the first object of the invention is to provide silver halide color photographic materials which are good in white base staining. The second object of the invention is to provide silver halide color photographic materials which do not cause the functions of the development bath to deteriorate during color development processing. The third object of the invention is to provide silver halide color photographic materials which have good colored image stability.

As a result of thorough research carried out with a view to providing silver halide color photographic materials which satisfy all of the above mentioned objectives, the inventors have discovered that these objects can be realized by combining hydroquinone derivatives which have a specified structure as described below with organic anti-color fading agents or organometallic complexes.

In other words, the objects of the invention have been realized by means of a silver halide color photographic material comprising a support having thereon at least one silver halide emulsion layer, wherein there are included at least one of the hydroquinone derivatives represented by general formula [I] indicated below and at least one selected from among (1) the organic anti-color fading agents which can be represented by general formula [II] indicated below or (2) the organometallic complexes which have copper, cobalt, nickel, palladium or platinum as the central metal and have at least one bidentate organic ligand.

Thus, the aforementioned objects of the invention have been realized by means of a silver halide color photographic material comprising a support having thereon at least one silver halide emulsion layer, wherein the photographic material contains at least one type of compound which can be represented by general formula [I] indicated below, and at least one type of compound which can be represented by general formula [II] indicated below or an organometallic complex which has copper, cobalt, nickel, palladium or platinum as the central metal and which has at least one bidentate organic ligand.

General Formula [I]

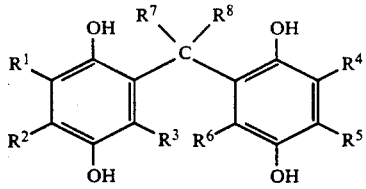

In general formula [I], $R^1$, $R^2$, $R^3$, $R^4$, $R^5$ and $R^6$, which may be the same or different, represent hydrogen atoms, halogen atoms, sulfo groups, carboxyl groups, cyano groups, alkyl groups, aryl groups, acylamino groups, sulfonamido groups, alkoxy groups, aryloxy groups, alkylthio groups, arylthio groups, acyl groups, acyloxy groups, sulfonyl groups, carbamoyl groups, alkoxycarbonyl groups or sulfamoyl groups, and $R^1$ and $R^2$, and $R^4$ and $R^5$, may together form a carbocyclic or a heterocyclic ring. $R^7$ represents an alkyl group, an aryl group or an aralkyl group. $R^8$ represents a hydrogen atom or a group the same as $R^7$. Furthermore, $R^7$ and $R^8$ may together form a carbocyclic or a heterocyclic ring.

$R_{10}$—W—$R_{11}$ General Formula [II]

In this formula, $R_{10}$ represents an aliphatic group, an aromatic group or a heterocyclic group. $R_{11}$ represents a hydrogen atom, an aliphatic group, an aromatic group, a heterocyclic group or

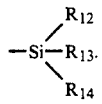

Here, $R_{12}$, $R_{13}$ and $R_{14}$ may be the same or different, each representing an alkyl group, an alkenyl group, an aryl group, an alkoxy group, an alkenoxy group or an aryloxy group. W represents —O—, —S— or

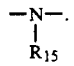

Here, $R_{15}$ represents a hydrogen atom, an aliphatic group, an aromatic group, a heterocyclic group, an acyl group, a sulfonyl group, a sulfinyl group, an oxy radical group or a hydroxyl group.

$R_{10}$ and $R_{11}$ may be joined together to form a five to seven membered ring, and $R_{15}$ and $R_{10}$ or $R_{11}$ may be joined together to form a five to seven membered ring.

DETAILED DESCRIPTION OF THE INVENTION

General formula [I] is described in more detail below. $R^1$, $R^2$, $R^3$, $R^4$, $R^5$ and $R^6$ represent hydrogen atoms, halogen atoms (for example, chlorine, bromine, fluorine), sulfo groups, carboxyl groups, cyano groups, alkyl groups (which have from 1 to 30 carbon atoms, for example, methyl, t-butyl, cyclohexyl, t-octyl, hexadecyl, benzyl, allyl), aryl groups (which have from 6 to 30 carbon atoms, for example, phenyl, p-tolyl), acylamino groups (which have from 2 to 30 carbon atoms, for example, acetylamino, benzoylamino), sulfonamido groups (which have from 1 to 30 carbon atoms, for example, methanesulfonamido, benzenesulfonamido), alkoxy groups (which have from 1 to 30 carbon atoms, for example, methoxy, butoxy, benzyloxy, dodecyloxy), aryloxy groups (which have from 6 to 30 carbon atoms, for example, phenoxy, p-methoxyphenoxy), alkylthio groups (which have from 1 to 30 carbon atoms, for example, butylthio, dodecylthio), arylthio groups (which have from 6 to 30 carbon atoms, for example, phenylthio, p-hexyloxyphenylthio), acyl groups (which have from 2 to 30 carbon atoms, for example, acetyl, benzoyl, hexanoyl), acyloxy groups (which have from 1 to 30 carbon atoms, for example, acetyloxy, benzoyloxy), sulfonyl groups (which have from 1 to 30 carbon atoms, for example, methanesulfonyl, benzenesulfonyl), carbamoyl groups (which have from 1 to 30 carbon atoms, for example, N,N-diethylcarbamoyl, N-phenylcarbamoyl), alkoxycarbonyl groups (which have from 2 to 30 carbon atoms, for example, methoxycarbonyl, butoxycarbonyl) or sulfamoyl groups (which have from 0 to 30 carbon atoms, for example, N,N-dipropylsulfamoyl, N-phenylsulfamoyl) and, moreover, $R^1$ and $R^2$, and $R^4$ and $R^5$, may together form carbocyclic or heterocyclic rings (for example, cyclopentene, bicyclo[2,2,2]octene, dehydropiperidine or dehydropiperazine ring).

The alkyl groups represented by $R^7$ have from 1 to 30 carbon atoms and these include ethyl and n-propyl for example as well as those described in connection with $R^1$. The aryl groups represented by $R^7$ have from 6 to 30 carbon atoms, such as phenyl, p-tolyl, p-nonylphenyl for example. The aralkyl groups represented by $R^7$ have from 7 to 30 carbon atoms, such as benzyl for example.

$R^8$ represents a hydrogen atom or a group the same as those described for $R^7$. Furthermore, $R^7$ and $R^8$ may together form a carbocyclic or heterocyclic ring (for example, cyclopentane, bicyclo[2,2.1]heptane, piperidine or pyrolyne ring].

$R^1$–$R^6$, and $R^7$ and $R^8$ in general formula [I] may also be further substituted with alkyl groups, aryl groups, alkoxy groups, aryloxy groups, sulfo groups, carboxyl groups, amido groups, carbamoyl groups, halogen atoms and other generally known substituent groups.

In general formula [I], the total number of carbon atoms in $R^1$–$R^8$ is from 1 to 40, preferably from 3 to 35, more desirably from 5 to 25, and most desirably from 8 to 20.

In general formula [I], $R^1$–$R^8$ preferably represent hydrogen atoms, halogen atoms, alkyl groups, aryl groups, acylamino groups or alkylthio groups, more desirably they represent hydrogen atoms, alkyl groups, acylamino groups or alkylthio groups, and most desirably they represent hydrogen atoms or alkyl groups.

In general formula [I], $R^7$ preferably has not more than 3 carbon atoms, and $R^8$ preferably represents a hydrogen atom.

Actual examples of compounds of general formula [I] of this invention are indicated below, but the compounds are not limited to these examples.

(1)
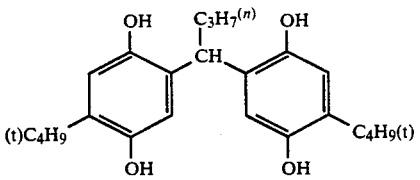
(2)
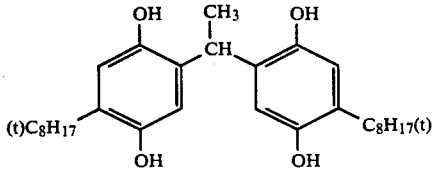
(3)
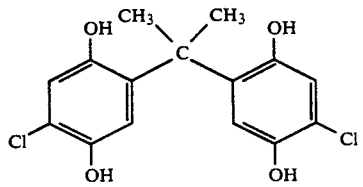
(4)
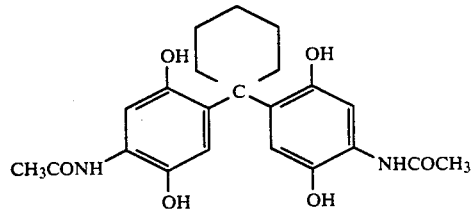
(5)
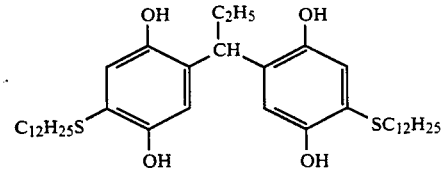
(6)
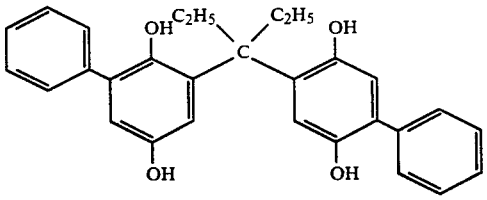
(7)
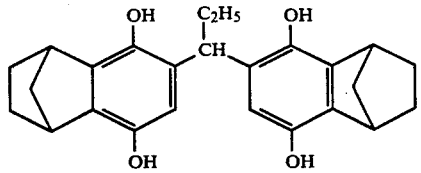
(8)
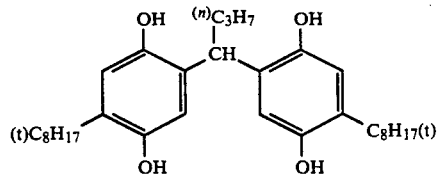
-continued
(9)
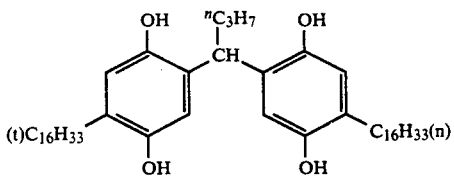
(10)
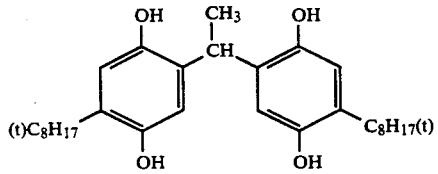
(11)
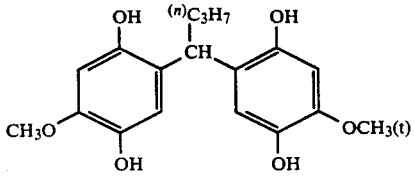
(12)
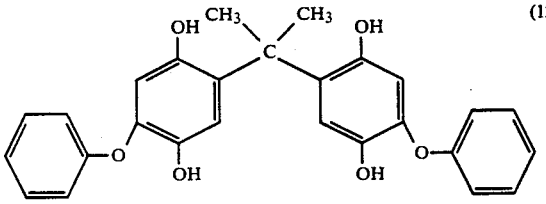
(13)
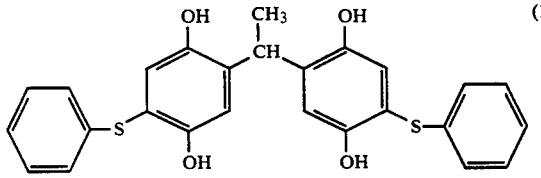
(14)
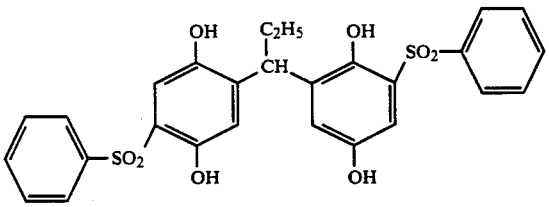
(15)
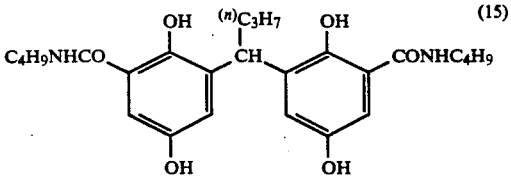
(16)
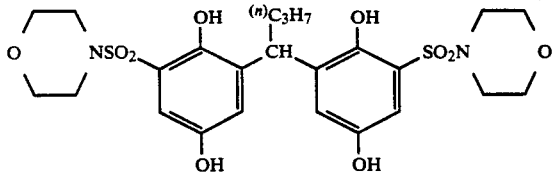

-continued (17)

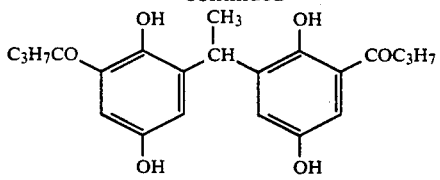

(18)

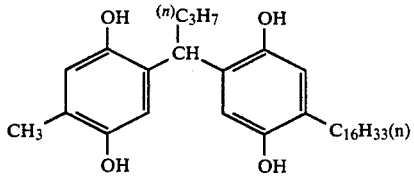

(19)

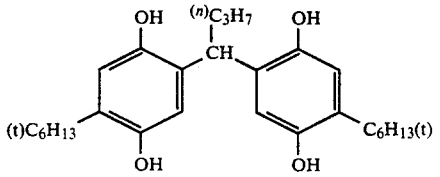

(20)

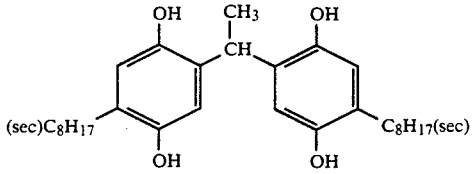

(21)

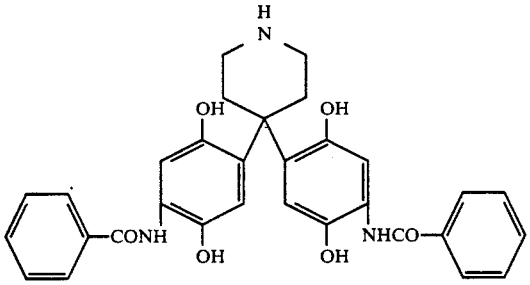

(22)

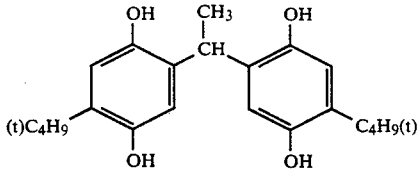

(23)

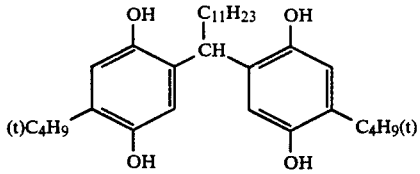

(24)

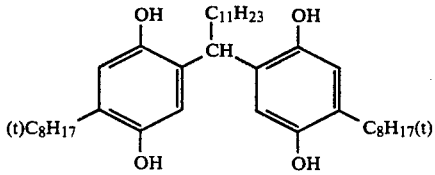

Compounds of general formula [I] of this invention can generally be prepared in accordance with the methods disclosed in U.S. Pat. No. 2,735,765 and JP-B-56-21145.

The amount of the compound represented by general formula [I] added is from about $1\times10^{-8}$ mol/m$^2$ to about $1\times10^{-2}$ mol/m$^2$, preferably from about $1\times10^{-7}$ mol/m$^2$ to about $1\times10^{-3}$ mol/m$^2$, and most desirably from about $1\times10^{-6}$ mol/m$^2$ to about $1\times10^{-4}$ mol/m$^2$.

The compounds represented by the aforementioned general formula [I] can be added to an emulsion layer, an intermediate layer or a protective layer, or even to a backing layer, but they are preferably added to an emulsion layer or an intermediate layer adjacent thereto.

The compounds represented by general formula [II] are described in detail below.

The aliphatic groups mentioned in connection with $R_{10}$, $R_{11}$ and $R_{15}$ are linear chain, branched chain or cyclic alkyl groups (for example, methyl, ethyl, iso-propyl, t-$C_8H_{17}$), alkenyl groups or alkinyl groups and these may be substituted with substituent groups. The aromatic groups mentioned in connection with $R_{10}$, $R_{11}$ and $R_{15}$ may be either carbocyclic aromatic groups (for example, phenyl, naphthyl), or heterocyclic aromatic groups (for example, furyl, thienyl, pyrazolyl, pyridyl, indolyl), and they may be single ring systems or condensed ring systems (for example, benzofuryl, phenanthridinyl), and they may be substituted with substituent groups.

The heterocyclic groups mentioned in connection with $R_{10}$ and $R_{11}$ are from three to ten membered cyclic groups in which at least one atom is selected from among oxygen, nitrogen and sulfur and is a structural atom of the ring, and the heterocyclic ring itself may be saturated or unsaturated, and it may be further substituted with substituent groups (for example, chromanyl, pyrrolidyl, pyrrolinyl, morpholinyl).

$R_{12}$, $R_{13}$ and $R_{14}$ may be the same or different, each representing an alkyl group (a linear chain, branched chain or cyclic alkyl group, for example, methyl, ethyl, isopropyl, tert-butyl, hexyl, octyl, cyclohexyl, hexadecyl, benzyl), an alkenyl group (for example, vinyl, allyl), an aryl group (for example, phenyl, p-methylphenyl, 2-chlorophenyl, 3-methoxyphenyl, 2,4-dimethoxyphenyl, 4-hexadecyloxyphenyl, 3-pentadecylphenyl, 4-bromophenyl, naphthyl), an alkoxy group (for example, methoxy, ethoxy, isopropyloxy, cyclohexyloxy, benzyloxy, hexadecyloxy, methoxyethoxy), an alkenoxy group (for example, allyloxy), or an aryloxy group (for example, phenoxy, 4-methoxyphenoxy, 3-chlorophenoxy, 2-methylphenoxy, 2-tert-butyl-4-methylphenoxy, 4-hexadecyloxyphenoxy, naphthyloxy].

Examples of rings formed by $R_{10}$ and $R_{11}$, and $R_{15}$ and $R_{10}$ or $R_{11}$ include a piperidine, piperazinine, morpholine, cyclopentane, cyclohexane, bicyclo[2,2,2]octane, tetrahydrofurane and dioxane ring.

The preferred compounds represented by general formula [II] are those which can be represented by general formulae [II-a]-[II-f] indicated below.

General Formula [II-a]

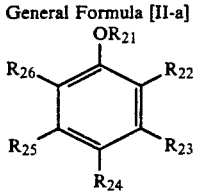

-continued

General Formula [II-b]

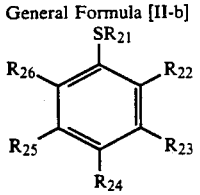

General Formula [II-c]

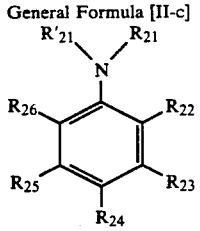

General Formula [II-d]

$R_{30}—O—R_{31}$

General Formula [II-e]

$R_{30}—S—R_{31}$

General Formula [II-f]

$R_{30}—N(R_{15})—R_{31}$

In these formulae, $R_{21}$ represents a hydrogen atom, an aliphatic group (for example, methyl, ethyl, propyl, t-$C_8H_{17}$ which may be substituted with a halogen atom, alkoxy, alkoxycarbonyl, alkylamido, aryloxy or aryloxycarbonyl), an aromatic group (for example, phenyl), a heterocyclic group which has one or two hetero atoms in the ring structure, or

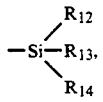

$R_{12}$, $R_{13}$ and $R_{14}$ have the same significance as described in connection with general formula [II].

$R_{22}$–$R_{26}$ may be the same or different, each representing a hydrogen atom, —W—$R_{11}$, an aliphatic group (for example, methyl, ethyl, propyl, t-$C_9H_{17}$ which may be substituted with a halogen atom, alkoxy, alkoxycarbonyl, alkylamido, aryloxy or aryloxycarbonyl), an aromatic group (for example, phenyl), a heterocyclic group which has one or two hetero atoms in the ring structure, a diacylamino group, a halogen atom, a sulfonyl group, a sulfinyl group, an alkoxycarbonyl group, an aryloxycarbonyl group, a urerido group, a urethane group, a sulfamoyl group, a carbamoyl group, a cyano group, a nitro group, a carbonyloxy group, a sulfonyloxy group, a silyloxy group or an imido group. Here, —W—$R_{11}$ has the same significance as described in connection with general formula [II]. $R_{21}$ and $R_{22}$ may be joined together to form a five to seven membered ring. Further, among substituents $R_{22}$–$R_{26}$, two of those which are in positions ortho to each other may be joined together to form a five to seven membered ring.

Furthermore, $R_{11}$ and $R_{15}$ when W is

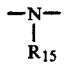

can be joined together when the groups are in ortho positions with respect to the position at which the group is substituted and form a five to seven membered ring.

The five to seven membered rings defined here may be single ring or condensed ring systems, spiro rings, bicyclo rings, and the result of the joining together and ring formation may be an alicyclic, aromatic, heterocyclic or heterocyclic aromatic ring, and these may be further substituted with substituent groups.

Examples of rings formed by $R_{21}$ and $R_{22}$, $R_{11}$ and $R_{15}$ and $R_{22}$–$R_{26}$ include a cyclopentane, cyclohexane, bicyclo[2,2,2]octane, piperidine, tetrahydrofuran and dioxane ring.

$R'_{21}$ has the same significance as that defined for $R_{21}$ described above provided that $R'_{21}$ is not a silyl group $R'_{21}$ can be joined with $R_{22}$ or $R_{21}$ in the same way as $R_{22}$ can be joined to $R_{21}$ to form a five to seven membered ring as defined above.

$R_{30}$ represents an aliphatic group, a heterocyclic aromatic group, or a heterocyclic group. $R_{31}$ represents a hydrogen atom, an aliphatic group, a heterocyclic aromatic group or a heterocyclic group.

$R_{15}$ has the same significance as that described in connection with general formula [II].

$R_{30}$ and $R_{31}$, $R_{30}$ and $R_{15}$ or $R_{31}$ and $R_{15}$ may be joined together to form a five to seven membered ring as described above.

Of the compounds represented by general formulae [II-a]–[II-f], those represented by general formulae [II-a] and [II-f] are preferred, and these compounds can be used in combination. Of these compounds, those which can be represented by general formulae [II-$a_1$]–[II-$a_8$] and [II-$f_1$] are especially desirable.

General Formula [II-$a_1$]

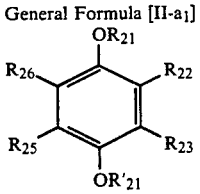

General Formula [II-$a_2$]

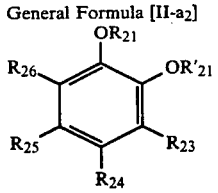

General Formula [II-$a_3$]

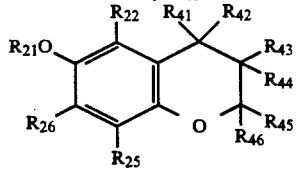

General Formula [II-$a_4$]

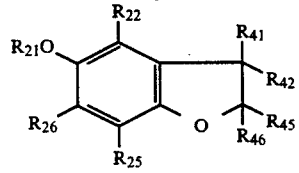

-continued

General Formula [II-a5]

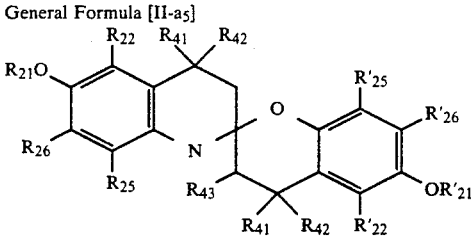

General Formula [II-a6]

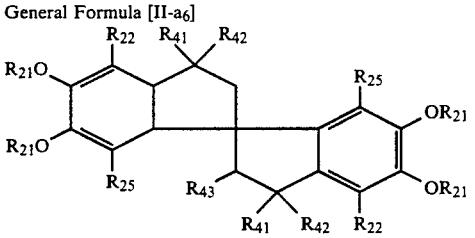

General Formula [II-a7]

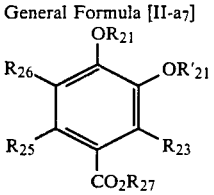

General Formula [II-a8]

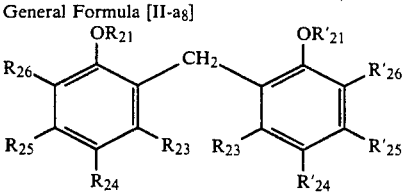

General Formula [II-f1]

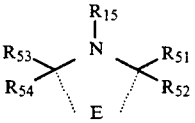

In these formulae, $R_{21}$–$R_{26}$ have the same significance as described earlier in connection with general formula [II-a]. $R'_{21}$ has the same significance as $R_{21}$ provided that $R'_{21}$ is not a silyl group and $R'_{22}$–$R'_{26}$ have the same significance as $R_{22}$–$R_{26}$ respectively. However, cases in which, in general formula [II-a8], $R_{24}$ and $R'_{24}$ are both hydroxyl groups are excluded. $R_{27}$ has the same significance as $R_{21}$ defined in connection with general formulae [II-a]–[II-f]. E represents a group of non-metal atoms which are required to form a five to seven membered ring (for example, piperidine, pyrrolidine, morpholine ring) with —N.

Furthermore, these substituent groups may be joined together to form five to seven membered rings in the same way as in general formula [II-a]. $R_{41}$–$R_{44}$ may be the same or different, each representing a hydrogen atom, an aliphatic group (for example, methyl, ethyl, propyl), an aromatic group (for example, phenyl) or a heterocyclic group. $R_{45}$ and $R_{46}$ may be the same or different, each representing a hydrogen atom, an aliphatic group, an aromatic group, a heterocyclic group, an alkoxy group, an aryloxy group, an alkylthio group, an arylthio group, an alkylamino group, an acylamino group, or

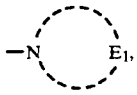

where $E_1$ represents a group of non-metal atoms which are required to form a five to seven membered ring (for example, piperidine, pyrrolidine, morpholine ring) with —N.

$R_{15}$ has the same significance as described in connection with general formula [II-f]. E represents a group of non-metal atoms which is required to form a five to seven membered ring. $R_{51}$–$R_{54}$ may be the same or different, each representing a hydrogen atom or an alkyl group (for example, methyl, ethyl, iso-propyl, t-butyl).

The organometallic complexes of the present invention are described in detail below. The metal complexes used in the invention are organometallic complexes which have copper, cobalt, nickel, palladium or platinum as the central metal and have at least one bidentate organic ligand. Of these complexes, those which have nickel as the central atom are preferred. The atoms which are coordinated with the central metal atom are preferably nitrogen atoms, sulfur atoms, oxygen atoms or phosphorus atoms.

The most desirable structures for the organometallic complexes of the present invention are represented by general formulae [V-a]–[V-d].

General Formula [V-a]

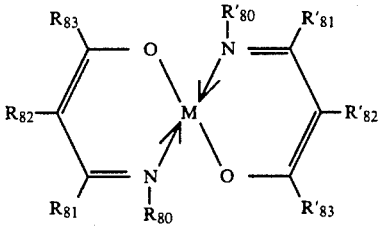

General Formula [V-b]

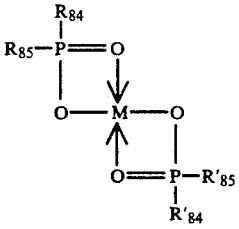

General Formula [V-c]

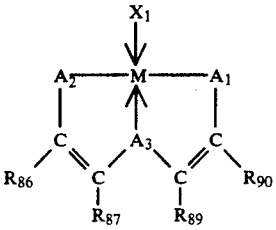

General Formula [V-d]

-continued

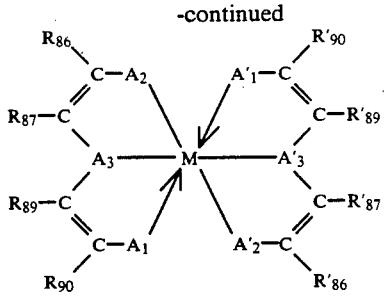

In these formulae, M represents copper, cobalt, nickel, palladium or platinum. $R_{80}$ and $R'_{80}$ may be the same or different, each representing a hydrogen atom, an alkyl group, an aryl group or a hydroxyl group. Here $R_{80}$ and $R'_{80}$ may be joined together. $R_{81}$, $R_{82}$, $R_{83}$, $R'_{31}$, $R'_{82}$ and $R'_{83}$ may be the same or different, each representing a hydrogen atom, an alkyl group or an aryl group. Here, $R_{82}$ and $R_{83}$, and $R'_{82}$ and $R'_{83}$ may be joined together to form an aromatic or five to eight membered ring. $R_{84}$, $R_{85}$, $R'_{84}$ and $R'_{85}$ may be the same or different, each representing an alkyl group, an aryl group, an alkylthio group, an arylthio group, an alkoxy group, an aryloxy group, an alkylamino group or an arylamino group. $R_{86}$–$R_{90}$, $R'_{86}$–$R'_{90}$ may be the same or different, each representing a hydrogen atom, an alkyl group or an aryl group. Examples of $R_{80}$–$R_{90}$ and $R'_{80}$–$R'_{90}$ include a methyl, ethyl, phenyl and naphthyl group. Here, at least one of the pairs $R_{86}$ and $R_{87}$, $R_{89}$ and $R_{90}$, $R'_{86}$ and $R'_{87}$, or $R'_{89}$ and $R'_{90}$ may be joined together to form an aromatic or a five to eight membered ring. $X_1$ represents a compound which can coordinate with M (for example, $Cl^{\ominus}$, $Br^{\ominus}$,

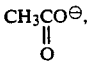

$BF_4^{\ominus}$, $CN^{\ominus}$, $SCN^{\ominus}$, $^{\ominus}$S-alkyl, $OH^{\ominus}$). $A_1$, $A_2$, $A'_1$ and $A'_2$ may be the same or different, each representing an oxygen atom, a sulfur atom, —$NR_{91}$—, a hydroxyl group, an alkoxy group, an alkylthio group or

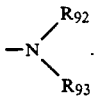

Here, $R_{91}$ represents a hydrogen atom, an alkyl group, an aryl group, a hydroxyl group or an alkoxy group, and $R_{92}$ and $R_{93}$ may be the same or different, each representing a hydrogen atom or an alkyl group. $A_3$ and $A'_3$ represent oxygen atoms, sulfur atoms or —NH— groups.

Actual examples of compounds of formula [II] and the organometallic complexes of the invention are illustrated below, but the invention is not limited to these examples.

A-1

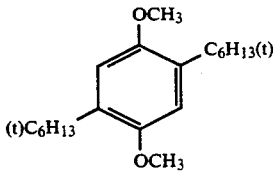

-continued

A-2

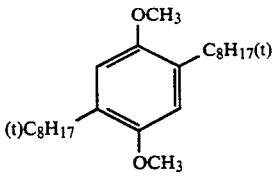

A-3

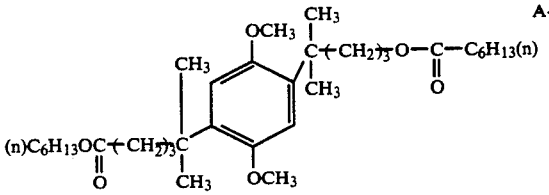

A-4

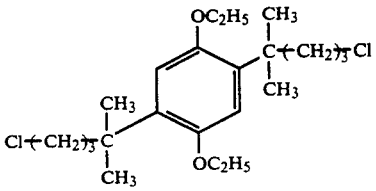

A-5

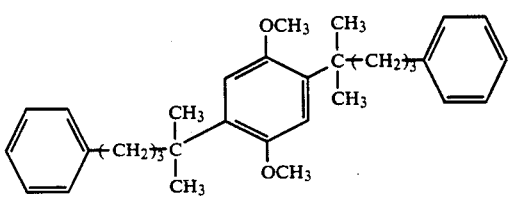

A-6

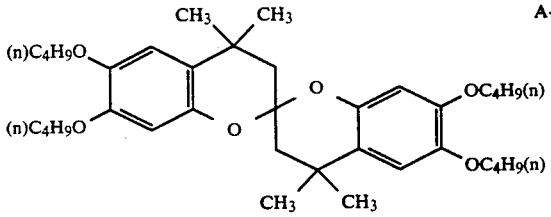

A-7

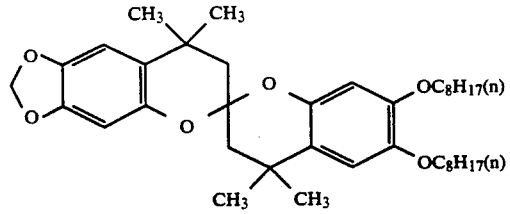

A-8

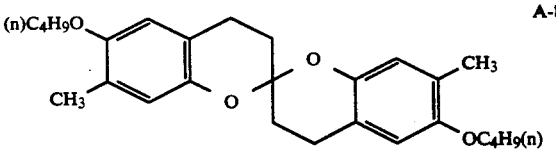

A-9

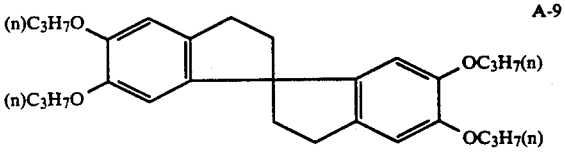

-continued

A-10

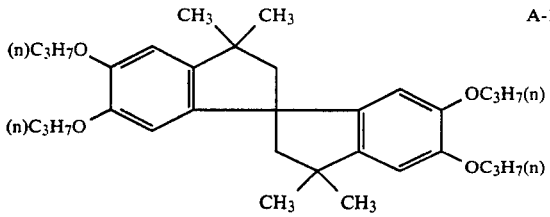

A-11

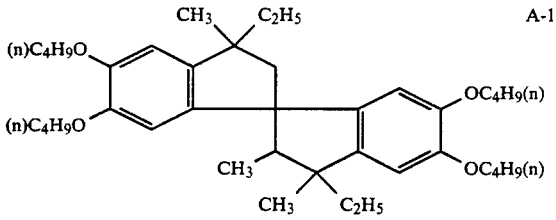

A-12

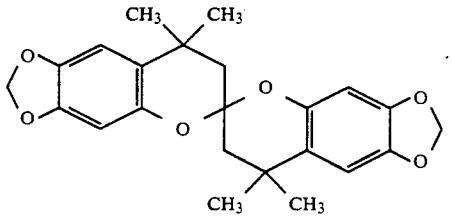

A-13

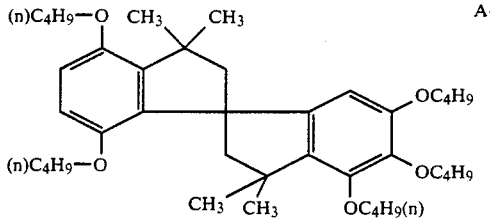

A-14

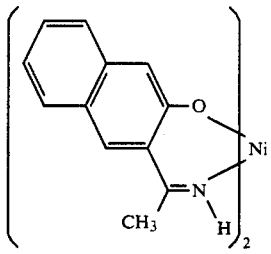

A-15

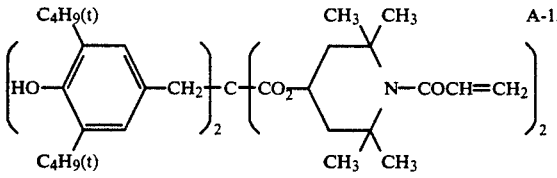

A-16

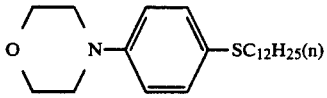

A-17

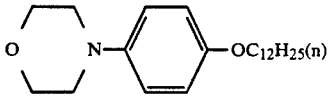

A-18

$CH_2{=}CH_2OC_{14}H_{29}(n)$

-continued

A-19

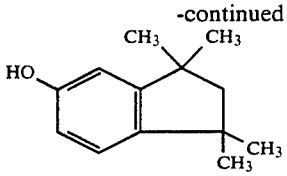

A-20

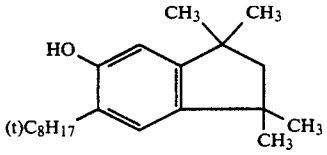

A-21

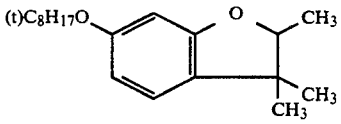

The compounds of general formula (II) and the organometallic complexes of the present invention can be prepared using the methods disclosed in the specifications of U.S. Pat. Nos. 3,336,135, 3,432,300, 3,573,050, 3,574,627, 3,700,455, 3,764,337, 3,935,061, 3,982,944, 4,254,216 and 4,279,990, British Patents 1,347,556, 2,062,888, 2,066,975 and 2,077,455, JP-A-60-97353, JP-A-52-152225, JP-A-53-17729, JP-A-53-20327, JP-A-54-145530, JP-A-55-6321, JP-A-55-21004, JP-A-58-24141, JP-A-59-10539, JP-A-62-67536, JP-B-48-31625 and JP-B-54-12337, and methods based upon the methods disclosed therein.

Furthermore, the amount of the compounds of general formula (II) or the organometallic complexes added is from about 0.1 mg/m$^2$ to about 10 g/m$^2$, and preferably from about 1 mg/m$^2$ to about 5 g/m$^2$, or is from about $1\times10^{-2}$ to about 10 mol, and preferably from about $3\times10^{-2}$ to about 5 mol, per mol of coupler.

The compounds of general formula (II) or the. organometallic complexes can be added to an emulsion layer, an intermediate layer or a protective layer, or even to a backing layer, but they are preferably added to an emulsion layer or an intermediate layer adjacent thereto.

In the direct positive color photosensitive materials described hereinafter, the tonal range must be realized with a narrower exposure range than that of a general negative type photosensitive material, and a photosensitive material which has superior white base properties is required. Furthermore, in many cases direct positive color photosensitive materials are processed by users and the demands with respect to development bath contamination are severe. Hence, the present invention is preferably applied to direct positive color photosensitive materials.

All of the silver halides, namely silver bromide, silver iodobromides, silver iodochlorobromides, silver chlorobromides and silver chloride, can be used in the photographic emulsion layers of the photographic materials in which the invention is used.

The silver halide grains in the emulsion may be so-called regular grains which have a regular crystalline form, such as a cubic, octahedral or tetradecahedral form, or they may have an irregular crystalline form, such as a spherical form, or they may have crystal defects, such as twinned crystal planes for example, or they may have a form which is a composite of these forms. Mixtures of various crystalline forms can also be used.

The size of the silver halide grains may be very small, for example, less than about 0.1 microns, or the grains may be of a large size with a projected area diameter of up to about 10 microns, and the emulsions may be monodisperse emulsions with a narrow grain size distribution or poly-disperse emulsions with a wide grain size distribution.

The silver halide photographic emulsions which are used in the present invention can be prepared, for example, using the known methods disclosed in *Research Disclosure* Vol. 176, No. 17643 (December, 1978), pages 22–23, "I. Emulsion Preparation and Types", and ibid, Vol. 187, No. 18716 (November 1979), page 648.

The photographic emulsions used in the invention can be prepared using the methods described by P. Glafkides in *Chimie et Physique Photographicue,* published by Paul Montel, 1967, by G. F. Duffin in *Photographic Emulsion Chemistry,* published by Focal Press, 1966, and by V. L. Zelikmann et al. in *Making and Coating Photographic Emulsions,* published by Focal Press, 1964. That is to say, acidic methods, neutral methods or ammonia methods can be used, and a single jet-mixing method, a simultaneous mixing method, or a combination of these methods may be used for the system with which the soluble halogen salt is reacted with the soluble silver salt. The grains can also be formed in the presence of excess silver ion (in a so-called reverse mixing method). The method in which the pAg value in the liquid phase in which the silver halide is being formed is held constant, the so-called controlled double jet method, can also be used as one type of simultaneous mixing method. Silver halide emulsions with a regular crystalline form and an almost uniform grain size can be obtained using this method.

Physical ripening can also be carried out in the presence of known silver halide solvents (for example, ammonia, potassium thiocyanate or the thioethers and thione compounds disclosed, for example, in U.S. Pat. No. 3,271,157, JP-A-51-12360, JP-A-53-82408, JP-A-53-144319, JP-A-54-100717 or JP-A-54-155828). Silver halide emulsions in which the crystalline form is regular and the grain size distribution is approaching uniformity can also be obtained in this way.

Silver halide emulsions comprised of the aforementioned regular grains can be obtained by adjusting the pAg and pH values during grain formation. Details have been disclosed, for example, on pages 159–165 of *Photographic Science and Engineering,* Vol. 6, 1962, on pages 242–251 of *Journal of Photographic Science,* Vol. 12, 1964, and in U.S. Pat. No. 3,655,394 and British Patent 1,413,748.

The mono-disperse emulsions preferably used in the present invention typically have silver halide grains of an average grain size greater than about 0.05 microns, with at least 95% by weight of the grains having a grain size within ±40% of the average grain size. Moreover, emulsions of which the average grain size is from 0.15 to 2 microns, and which are at least 95% by weight, or in terms of the number of grains, of the silver halide grains are of a size within ±20% of the average grain size can also be used. Methods for the preparation of such emulsions have been disclosed in U.S. Pat. Nos. 3,574,628 and 3,655,394, and in British Patent 1,413,748. Furthermore, use of mono-disperse emulsions such as those disclosed, for example, in JP-A-48-8600, JP-A-51-39027, JP-A-51-83097, JP-A-53-137133, JP-A-54-48521, JP-A-54-99419, JP-A-58-37635 and JP-A-58-49938 is also desirable.

Furthermore, tabular grains of which the aspect ratio is at least 5 can also be used in this invention. Tabular grains can be prepared easily using the methods described, for example, by Gutoff in *Photographic Science and Engineering,* Vol. 14, pages 248–257 (1970), and in U.S. Pat. Nos. 4,434,226, 4,414,310, 4,433,048 and 4,439,520, and in British Patent 2,112,157. There are advantages in those cases where tabular grains are used in that the covering power is increased and the color sensitization efficiency with sensitizing dyes is increased. Details are given in the previously cited U.S. Pat. No. 4,434,226.

Sensitizing dyes and certain types of additives can be used during the grain growing process and grains of which the crystal form has been controlled in this way can also be used.

The crystal structure may be uniform, or it may take a form comprising inner and outer parts which have different halogen compositions and a layer structure may be formed. Such emulsion grains have been disclosed, for example, in British Patent 1,027,146, U.S. Pat. Nos. 3,505,068 and 4,444,877, and in Japanese Patent Application No. 58-248469. Furthermore, the silver halides which have different compositions may be joined epitaxially, or they may be joined with compounds other than silver halides, such as silver thiocyanate or lead oxide. Such emulsion grains have been disclosed, for example, in U.S. Pat. Nos. 4,094,684, 4,142,900 and 4,459,353, British Patent 2,038,792, U.S. Pat. Nos. 4,349,622, 4,395,478, 4,433,501, 4,463,087, 3,656,962 and 3,852,067, and JP-A-59-162540.

Moreover, grains which have a so-called internal latent image type grain structure for which the surface of the grains is chemically sensitized with the formation of sensitized nuclei (such as $Ag_2S$, Ag, Au for example) and subsequently surrounded by growing silver halide on these grains can also be used.

Cadmium salts, zinc salts, lead salts, thallium salts, iridium salts or complex salts thereof, rhodium salts or complex salts thereof, and iron salts or complex salts thereof, may also be present during the growth of the silver halide grains or during the physical ripening process.

These various types of emulsions may be of the surface latent image type in which the latent image is formed principally on the grain surface, or of the internal latent image type in which the latent image is formed principally within the grains.

Moreover, the emulsions may be direct reversal emulsions. Direct reversal emulsions may be of the solarization type, the internal latent image type, the light fogging type, or of the type with which a nucleating agent is used, or they may be of a type in which these processes are used conjointly.

From among these materials, the direct positive color photosensitive materials using an internal latent image type emulsion which has not been pre-fogged and with which fogging with light or by using a nucleating agent is carried out before or during processing are preferred.

The internal latent image type silver halide emulsions which have not been pre-fogged which are used in this invention are emulsions which contain silver halides in which the surface of the silver halide grains has not been pre-fogged and in which the latent image is formed principally within the grains. In more practical terms, they are silver halide emulsions with which, when coated at a fixed rate on a transparent support, the maximum density measured using the normal method for measuring photographic density after exposing for a fixed time of from 0.01 to 10 seconds and developing for 6 minutes at 20° C. in the developer A (an internal type developer) of which the composition is indicated below is preferably at least five times, and most desirably at least ten times, higher than the maximum density obtained on developing a sample exposed in the same way as before for 5 minutes at 18° C. in developer B (a surface type developer) of which the composition is indicated below.

| Internal Developer A | |
|---|---|
| Metol | 2 grams |
| Sodium sulfite (anhydrous) | 90 grams |
| Hydroquinone | 8 grams |
| Sodium carbonate (mono-hydrate) | 52.5 grams |
| KBr | 5 grams |
| KI | 0.5 gram |
| Water to make up to | 1 liter |
| Surface Developer B | |
| Metol | 2.5 grams |
| L-Ascorbic acid | 10 grams |
| $NaBO_2.4H_2O$ | 35 grams |
| KBr | 1 gram |
| Water to make up to | 1 liter |

Actual examples of internal latent image type emulsions include the conversion type silver halide emulsions and core/shell type silver halide emulsions disclosed, for example, in British Patent 1,011,062 and U.S Pat. Nos. 2,592,250 and 2,456,934, and examples of the core/shell type silver halide emulsions have been disclosed, for example, in JP-A-47-32813, JP-A-47-32814, JP-A-52-134721, JP-A-52-156614, JP-A-53-60222, JP-A-53-66218, JP-A-53-66727, JP-A-55-127549, JP-A-57-136641, JP-A-58-70221, JP-A-59-208540, JP-A-59-216136, JP-A-60-107641, JP-A-60-247237, JP-A-61-2148, JP-A-61-3137, JP-B-56-18939, JP-B-58-1412, JP-B-58-1415, JP-B-58-6935, JP-B-58-108528, JP-A-62-194248, U.S. Pat. Nos. 3,206,313, 3,317,322, 3,761,266, 3,761,276, 3,850,637, 3,923,513, 4,035,185, 4,395,478 and 4,504,570, European Patent 0017148, and *Research Disclosure,* No. 16345 (November 1977).

Noodle washing, flocculation sedimentation methods and ultrafiltration methods can be used, for example, to remove the soluble salts from the emulsions before or after physical ripening.

The emulsions used in the invention have normally been subjected to physical ripening, chemical ripening and spectral sensitization. Additives which can be used in such processes have been disclosed in *Research Disclosure* No. 17643 (December 1978) and ibid, No. 18716 (November 1979), and the locations of these disclosures are summarized in the table below.

Known photographically useful additives which can be used in the present invention are also disclosed in the two *Research Disclosures* referred to above, and the locations of these disclosures are also indicated in the table below.

| Type of Additive | RD 17643 | RD 18716 |
|---|---|---|
| 1. Chemical sensitizers | Page 23 | Page 648, right col. |
| 2. Speed increasing agents | | As above |
| 3. Spectral sensitizers and Super-sensitizers | Pages 23–24 | Pages 648 right col. to 649 right col. |
| 4. Whiteners | Page 24 | |
| 5. Anti-foggants and stabilizers | Pages 24–25 | Page 649, right col. |
| 6. Light absorbers, filter dyes and UV absorbers | Pages 25–26 | Pages 649, right col. to 650, left col. |
| 7. Anti-staining agents | Page 25, right col. | Page 650, left–right cols. |
| 8. Film hardening agents | Page 26 | Page 651, left col. |
| 9. Binders | Page 26 | As above |
| 10. Plasticizers, lubricants | Page 27 | Page 650, right col. |
| 11. Coating aids Surfactants | Pages 26–27 | As above |
| 12. Anti-static agents | Page 27 | As above |

Various color couplers can be used to form color images in the present invention. Color couplers are compounds which form or release dyes which are essentially fast to diffusion on undergoing a coupling reaction with the oxidized form of a primary aromatic amine based developing agent, and they are themselves preferably compounds which are essentially fast to diffusion. Typical examples of useful color couplers include naphthol or phenol based compounds, pyrazolone or pyrazoloazole based compounds, and open chain or heterocyclic ketomethylene compounds. Actual examples of these cyan, magenta and yellow couplers which can be used in the invention include the compounds disclosed on page 25 of *Research Disclosure,* No. 17643 (published December 1978), section VII-D, and ibid, No. 18717 (published November 1979), the compounds disclosed in JP-A-62-215272, and in the patents cited in these publications.

Among these, the oxygen atom elimination type and nitrogen atom elimination type two equivalent yellow couplers are typical of the yellow couplers which can be used in the invention. The use of α-pivaloylacetanilide based couplers is excellent in terms of the fastness, especially the light fastness, of the colored dye, while the use of α-benzoylacetanilide based couplers provides a high color density and is preferred.

Furthermore, the 5-pyrazolone based couplers which have an arylamino group or an acylamino group substituted in the 3-position (the sulfur atom elimination type two equivalent couplers from among these) are the preferred 5-pyrazolone based magenta couplers for use in this invention.

Moreover, the pyrazoloazole based couplers are desirable, and among these the pyrazolo[5,1-c][1,2,4]-triazoles, for example, disclosed in U.S. Pat. No. 3,725,067 are preferred, but the imidazo-[1,2-b]pyrazoles disclosed in U.S. Pat. No. 4,500,630 are even more desirable in view of the small absorbance on the yellow side, and the light fastness of the colored dye, and the pyrazolo[1,5-b][1,2,4]triazoles disclosed in U.S. Pat. No. 4,540,654 are especially desirable.

The naphthol based and phenol based couplers disclosed in U.S. Pat. Nos. 2,474,293 and 4,502,212, and the phenol based cyan couplers which have an alkyl group comprising an ethyl or larger group in the meta position of the phenol ring disclosed in U.S. Pat. No. 3,772,002 are the preferred cyan couplers for use in this invention, and the 2,5-diacylamino substituted phenol based couplers are also desirable in view of their colored image fastness.

Colored couplers for correcting the unwanted absorbance in the short wave length region of the dyes which are formed, couplers of which the colored dyes have a suitable diffusibility, non-color forming couplers, DIR couplers which release development inhibitors as the coupling reaction proceeds, and polymerized couplers can also be used.

The standard amount of coupler used is within the range from 0.001 to 1 mol per mol of photosensitive silver halide, and the amount of yellow coupler is preferably from 0.01 to 0.5 mol, the amount of magenta coupler is preferably from 0.03 to 0.5 mol, and the amount of cyan coupler is preferably from 0.002 to 0.5 mol, per mol of photosensitive silver halide.

Color intensifying agents can be used with a view to increasing the color forming properties of the couplers in the present invention. Typical examples of such compounds have been disclosed on pages 374–391 of JP-A-62-215272.

The couplers of this invention are dissolved in a high boiling point and/or a low boiling point organic solvent and emulsified and dispersed in an aqueous solution of gelatin or some other hydrophilic colloid by high speed agitation in a homogenizer for example, by fine mechanical division in a colloid mill for example, or by using ultrasonic techniques, and the resulting emulsified dispersion is added to the emulsion layer. It is not always necessary to use a high boiling point organic solvent, but the use of the compounds disclosed on pages 440–467 of JP-A-62-215272 is preferred.

The couplers of this invention can be dispersed in a hydrophilic colloid using the methods disclosed on pages 468–475 of JP-A-62-215272.

Photosensitive materials prepared using the present invention may contain hydroquinone derivatives, aminophenol derivatives, amines, gallic acid derivatives, catechol derivatives, ascorbic acid derivatives, non-color forming couplers and sulfonamidophenol derivatives for example. Typical anti-color fogging agents, and anti-color mixing agents have been disclosed on pages 600–663 of JP-A-62-215272.

The introduction of ultraviolet absorbers into the layers on either side of the color forming layer is effective for preventing the deterioration of the dye image due to heat or, more especially, light. Typical compounds have been disclosed on pages 391–400 of JP-A-62-215272.

The use of gelatin is convenient as a binding agent or protective colloid for use in the emulsion layers and intermediate layers of photosensitive materials of the present invention, but other hydrophilic colloids can be used for this purpose.

Dyes for the prevention of irradiation and halation, ultraviolet absorbers, plasticizers, fluorescent whiteners, matting agents, agents for preventing the occurrence of aerial fogging, coating promotors, film hardening agents, anti-static agents and slip improving agents, for example, can be added to photosensitive materials of the present invention. Typical examples of these additives have been disclosed on pages 25–27 of *Research Disclosure,* No. 17643, sections VIII–XII (published December 1978), and ibid, No. 18716, pages 647–651 (published November 1979).

In those cases where the photosensitive material of the present invention is a direct positive color photographic material in which an internal latent image type silver halide emulsion which has not been pre-fogged as mentioned earlier is used, a post imagewise exposure fogging treatment is carried out for forming the direct positive color image.

The above mentioned fogging treatment may be a whole surface exposure, or it can be achieved by including a nucleating agent in the photosensitive material, in the development processing bath or in a pre-bath. Details of these fogging treatments have been disclosed, for example, in JP-A-63-8740, JP-A-63-15248 and JP-A-63-46452.

Moreover, so-called nucleation accelerators which accelerate the above mentioned fogging treatments can be used, and details of these have also been disclosed in the above mentioned patents.

The invention can also be applied to multi-layer multi-color photographic materials having at least two different spectral sensitivities on a support. Multi-layer natural color photographic materials normally have, on a support, at least one red sensitive emulsion layer, at least one green sensitive emulsion layer and at least one blue sensitive emulsion layer. The order of these layers can be changed arbitrarily, as required. The preferred layer arrangements are, from the support side, red sensitive layer, green sensitive layer, blue sensitive layer or, from the support side, green sensitive layer, red sensitive layer, blue sensitive layer. Furthermore, each of the afore-mentioned emulsion layers may be comprised of two or more emulsion layers which have different photographic speeds, and non-photosensitive layers may be present between two or more emulsion layers which have the same sensitivity. Cyan forming couplers are normally included in the red sensitive emulsion layer, magenta forming couplers are normally included in the green sensitive emulsion layer, and yellow forming couplers are normally included in the blue sensitive emulsion layer, but different combinations can be used, depending on the particular case.

The compounds indicated below can be added with a view to increasing the maximum image density, lowering the minimum image density or speeding up development.

Hydroquinones (for example, the compounds disclosed in U.S. Pat. Nos. 3,227,552 and 4,279,987); chromans (for example, the compounds disclosed in U.S. Pat. No. 4,268,621, JP-A-54-103031, and on pages 333–334 of *Research Disclosure,* No. 18264 (published June 1979)), quinones (for example, the compounds disclosed on pages 433–434 of *Research Disclosure,* No. 21206 (published December 1981)); amines (for example, the compounds disclosed in U.S. Pat. No. 4,150,993 and JP-A-58-174757); oxidizing agents (for example, the compounds disclosed in JP-A-60-260039 and on pages 10–11 of *Research Disclosure,* No. 16936 (published May 1978)); catechols (for example, the compounds disclosed in JP-A-55-21013 and JP-A-55-65944); compounds which release nucleating agents during development (for example, the compounds disclosed in JP-A-60-107029); thioureas (for example, the compounds disclosed in JP-A-60-95533); and spirobisindanes (for example, the compounds disclosed in JP-A-55-65944).

In addition to the silver halide emulsion layers, the photosensitive materials of the present invention preferably have established the appropriate auxiliary layers, such as protective layers, intermediate layers, filter layers, anti-halation layers, backing layers and white reflecting layers for example.

The photographic emulsion layers and other layers in the photographic materials of the present invention are coated onto a support as disclosed in *Research Disclosure,* No. 17643, section XVII, page 28 (published December 1978), European Patent 0,102,253, or JP-A-61-97655. Furthermore, use can be made of the method of coating disclosed on pages 28–29 of *Research Disclosure,* No. 17643, section XV.

The present invention can be applied to various types of photographic materials.

For example, it can be applied typically to direct positive color photographic materials, negative color photographic materials, color reversal films for slides or television purposes, color reversal papers and instant camera films. Furthermore, it can also be applied to color hard copy for full color copying machines and for preserving CRT images. The invention can also be applied to black and white photosensitive materials in which tri-color coupler mixtures are used, as disclosed in *Research Disclosure,* No. 17123 (published July 1978).

The color development baths used in the development process of photosensitive materials of the present invention are preferably aqueous alkaline solutions which contain a primary aromatic amine based color developing agent as the principal component. Aminophenol based compounds are also useful as color developing agents, but the use of p-phenylenediamine based compounds is preferred. Typical examples of these compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfate, hydrochloride and p-toluenesulfonate salts of these compounds. Two or more of these compounds can be used conjointly, according to the intended purpose.

Moreover, pH buffers, such as alkali metal carbonates, borates or phosphates, and development inhibitors or anti-foggants, such as bromides, iodides, benzimidazoles, benzothiazoles or mercapto compounds, are generally included in the color development bath. Various preservatives such as hydroxylamine, diethylhydroxylamine, sulfites, hydrazines, phenylsemicarbazides, triethanolamine, catecholsulfonic acids and triethylenediamine(1,4-diazabicyclo[2,2,2]octane), organic solvents such as ethylene glycol and diethylene glycol, development accelerators such as benzyl alcohol, polyethylene glycol, quaternary ammonium salts and amines, dye forming couplers, competitive couplers, fogging agents such as sodium borohydride, auxiliary developing agents such as 1-phenyl-3-pyrazolidone, viscosity imparting agents, various chelating agents typified by the aminopolycarboxylic acids, aminopolyphosphonic acids, alkylphosphonic acids, phosphonocarboxylic acids, for example ethylenediamine tetraacetic acid, nitriloacetic acid, diethylenetriamine pentaacetic acid, cyclohexanediamine tetra-acetic acid, hydroxyethylimino diacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid) and salts thereof, can be used in the color development bath.

Color development is carried out after normal black and white development in cases where reversal processing is being used. The known black and white developing agents such as dihydroxybenzenes, for example, hydroquinone, 3-pyrazolidones, for example, 1-phenyl-3-pyrazolidone, or aminophenols, for example, N-methyl-p-aminophenol, can be used individually or in combinations in the black and white development bath.

The pH of these color development baths and black and white development baths is generally from 9 to 12. Furthermore, the amount of replenishment of these color development baths and black and white development baths depends on the color photographic photosensitive material which is being processed, but in general, it is not more than 3 liters per square meter of photosensitive material, and it can be set to less than 500 ml per square meter of photosensitive material if the bromide ion concentration of the replenisher is reduced. It is desirable that the area of contact with the air in the processing bath should be minimized to prevent evaporation and aerial oxidation of the bath in cases where the amount of replenishment is reduced. The replenishment amount can be further reduced by using some means of preventing the accumulation of bromide ion in the development bath.

The color developed photographic emulsion layer is normally subjected to a bleaching process. The bleaching process can be carried out at the same time as the fixing process (bleach-fix process) or it may be carried out separately. Moreover, a method of processing in which bleach-fixing is carried out after a bleaching process can be used in order to speed up processing. Furthermore, bleach-fixing can be carried out in two connected baths, a fixing process can be carried out prior to a bleach-fix process, or a bleaching process may be carried out after a bleach-fix process, in accordance with the intended purpose of the processing. Compounds of poly-valent metals, such as iron(III), cobalt(III), chromium(VI) and copper(II), peracids, quinones, and nitro compounds, for example, can be used as bleaching agents. Thus, ferricyanides; dichromates; organic complex salts of iron(III) or cobalt(III), for example, complex salts with aminopolycarboxylic acids such as ethylenediamine tetra-acetic acid, diethylenetriamine penta-acetic acid, cyclohexanediamine tetra-acetic acid, methylimino diacetic acid, 1,3-diaminopropane tetra-acetic acid and glycol ether diamine tetra-acetic acid, or citric acid, tartaric acid or malic acid for example; persulfates; bromates; permanganates; and nitrobenzenes can be used as typical bleaching agents. From among these materials, the use of the aminopolycarboxylic acid iron(III) salts, principally ethylenediamine tetra-acetic acid iron(III) salts, and persulfates, is preferred from the points of view of both rapid processing and the prevention of environmental pollution. Moreover, the aminopolycarboxylic acid iron(III) complex salts are especially useful in both bleach baths and bleach-fix baths. The pH of the bleach baths and bleach fix baths in which these aminopolycarboxylic acid iron(III) complex salts are used is normally from 5.5 to 8, but processing can be carried out at a lower pH in order to speed up processing.

Bleaching accelerators can be added, as required, to the bleach baths, bleach-fix baths or bleach or bleach-fix pre-baths.

Actual examples of useful bleach accelerators have been disclosed in the following specifications. Thus, the compounds which have a mercapto group or a disulfide group disclosed, for example, in U.S. Pat. No. 3,893,858, West German Patents 1,290,812 and 2,059,988, JP-A-53-32736, JP-A-53-7831, JP-A-53-37418, JP-A-53-72623, JP-A-53-95630 JP-A-53-5631, JP-A-53-104232, JP-A-53-124424, JP-A-53-141623, JP- A-3-28426, and *Research Disclosure,* No. 17129 (July 1978); the thiazolidine derivatives disclosed in JP-A-50-140129; the thiourea derivatives disclosed JP-B-45-8506, JP-A-52-20832, JP-A-53-32735 and U.S. Pat. No. 3,706,561; the iodides disclosed in West German Patent 1,127,715 and JP-A-58-16235; the polyoxyethylene compounds disclosed in West German Patents 966,410 and 2,748,430; the polyamide compounds disclosed in JP-B-45-8836; the other compounds disclosed in JP-A-49-42434, JP-A-49-59644, JP-A-53-94927, JP-A-54-35727, JP-A-55-26506 and JP-A-58-163940; and bromide ion, can be used for this purpose. From among these compounds, those which have a mercapto group or a disulfide group are preferred in view of their large accelerating effect, and the compounds disclosed in U.S. Pat. No. 3,893,858, West German Patent 1,290,812 and JP-A-53-95630 are especially desirable. Moreover, the compounds disclosed in U.S. Pat. No. 4,552,834 are also desirable. These bleach accelerators may also be included in the sensitive materials. These bleaching accelerators are especially effective with bleach-fixing camera color photosensitive materials.

Thiosulfates, thiocyanates, thioether based compounds, thioureas and large amounts of iodide can be used, for example, as fixing agents, but thiosulfates are normally used, and ammonium thiosulfate can be used in the widest range of applications. Sulfites, bisulfites, or carbonyl/ bisulfite addition compounds are preferred as preservatives for bleach-fix baths.

The silver halide color photographic materials of the present invention are generally subjected to a water washing process and/or stabilization process after the desilvering process. The amount of wash water used in a washing process can be fixed within a wide range, depending on the characteristics (for example, the materials such as couplers used therein) and application of the photosensitive material, the wash water temperature, the number of water washing tanks (the number of water washing stages), the replenishment system, i.e. whether a counter-flow or sequential flow system is used, and various other factors. The relationship between the amount of water used and the number of washing tanks in a multi-stage counter-flow system can be obtained using the method outlined on pages 248–253 of the *Journal of the Society of Motion Picture and Television Engineers,* Vol. 64 (May 1955).

The amount of wash water can be greatly reduced by using the multi-stage counter-flow system noted in the aforementioned literature, but bacteria proliferate due to the increased residence time of the water in the tanks, and the problems which arise with attachment of the suspended matter which is produced to the photosensitive material are present. The method in which the calcium ion and magnesium ion concentrations are reduced, as disclosed in JP-A-62-288838 can be used very effectively as a means of overcoming this problem when processing color photographic materials of the present invention. Furthermore, the isothiazolone compounds disclosed in JP-A-57-8542, thiabenzazoles, the chlorine based disinfectants such as chlorinated sodium isocyanurate, and benzotriazole, for example, and the disinfectants disclosed in "*The Chemistry of Biocides and Fungicides*" by Horiguchi, in "*Killing Micro-organisms, Biocidal and Fungicidal Techniques*" published by the Health and Hygiene Technical Society, and in "*A Dictionary of Biocides and Fungicides*" published by the Japanese Biocide and Fungicide Society, can also be used in this connection.

The pH value of the wash water when processing photosensitive materials of the present invention is from 4 to 9, and preferably from 5 to 8. The washing water temperature and the washing time can be set variously in accordance with the characteristics and application of the photosensitive material but, in general, washing conditions of from 20 seconds to 10 minutes at a temperature of from 15° C. to 45° C., and preferably of from 30 seconds to 5 minutes at a temperature of from 25° C. to 40° C., are selected. Moreover, the photosensitive materials of this invention can be processed directly in a stabilizing bath instead of being subjected to a water wash as described above. The known methods disclosed in JP-A-57-8543, JP-A-58-14834 and JP-A-60-220345 can all be used for such stabilization processes.

Furthermore, in some cases a stabilization process is carried out following the aforementioned water washing process, and the use of a final bath for camera color photosensitive materials is an example of this type of process. These can be stabilizer baths which contain formalin and surfactant. Various chelating agents and fungicides can be added to these stabilizing baths.

The overflow which accompanies replenishment of the above mentioned water washing and/or stabilizing baths can be reused in other processes, such as the desilvering process.

Color developing agents can be incorporated into a silver halide color photosensitive material of the present invention with a view to simplifying and speeding up processing. The use of various color developing agent precursors is preferred for incorporation. For example, the indoaniline based compounds disclosed in U.S. Pat. No. 3,342,597, the Schiff's base type compounds disclosed in U.S. Pat. No. 3,342,599 and *Research Disclosure,* No.14850, and ibid, No.15159, the aldol compounds disclosed in *Research Disclosure,* No.13924, the metal complex salts disclosed in U.S. Pat. No. 3,719,492, and the urethane based compounds disclosed in JP-A-53-135628, can be used for this purpose.

Various 1-phenyl-3-pyrazolidones can be incorporated, as required, into the silver halide color photosensitive materials of the present invention with a view to accelerating color development. Typical compounds have been disclosed, for example, in JP-A-56-64339, JP-A-57-144547 and JP-A-58-15438.

The various processing baths in this invention are used at a temperature of from 10° C. to 50° C. The standard temperature is normally from 33° C. to 38° C., but accelerated processing and shorter processing times can be realized at higher temperatures while increased picture quality and improved processing bath stability can be achieved at lower temperatures. Furthermore, processes using cobalt intensification or hydrogen peroxide intensification, as disclosed in West German Patent 2,226,770 or U.S. Pat. No. 3,674,499, can be used in order to economize on silver in the photosensitive material.

ILLUSTRATIVE EXAMPLES

The invention is described in more detail below by means of illustrative examples.

EXAMPLE 1

A silver halide color photographic material was prepared by lamination coating the first to the fourteenth layers indicated below on the surface of a paper support which had been laminated on both sides with polyethylene (thickness 100 microns) and lamination coating the fifteenth and sixteenth layers indicated below on the reverse side of the support. Titanium oxide as a white pigment and a trace of ultramarine as a bluing dye were included in the polyethylene on the side of the support on which the first layer was coated. (The chromaticity of this surface of the support in the L*, a*, b* system was 88.0, −0.20, −0.75.)

Photosensitive Layer Composition

The components and coated weights (in units of g/m$^2$) are indicated below. The coated weights for the silver halides are the coated weight calculated as silver. The emulsions used in each layer were prepared using the method used to prepare the emulsion EM-1. However, a Lippman emulsion with no surface chemical sensitization was used for the emulsion in the fourteenth layer.

| | |
|---|---|
| First Layer (Anti-halation Layer) | |
| Black solloidal silver | 0.10 |
| Gelatin | 0.70 |
| Second Layer (Intermediate Layer) | |
| Gelatin | 0.70 |
| Third Layer (Low Speed Red Sensitive Layer) | |
| Silver bromide (average grain size 0.25μ, size distribution (variation coefficient) 8%, octahedral) spectrally sensitized with the red sensitizing dyes (ExS-1, 2, 3) | 0.04 |
| Silver chlorobromide (5 mol % AgCl, average grain size, 0.40μ, size distribution 10%, octahedral) spectrally sensitized with the red sensitizing dyes (ExS-1, 2, 3) | 0.08 |
| Gelatin | 1.00 |
| Cyan coupler (ExC-1, 2, 3 in the ratio 1:1:0.2 (by wt.)) | 0.30 |
| Ultraviolet absorber (Equal amounts (wt.) of Spd-1, 2, 3) | 0.18 |
| Anti-staining agent (Cpd-4) | 0.003 |
| Coupler dispersion medium (Cpd-5) | 0.03 |
| Coupler solvent (Equal amounts (vol.) of Solv-1, 2, 3) | 0.12 |
| Fourth Layer (High Speed Sensitive Layer) | |
| Silver bromide (average grain size 0.60μ, size distribution 15%, octahedral) spectrally sensitized with the red sensitizing dyes (ExS-1, 2, 3) | 0.14 |
| Gelatin | 1.00 |
| Cyan coupler (ExC-1, 2, 3; 1:1:0.2 (by wt.)) | 0.30 |
| Ultraviolet absorber (Equal amounts (wt.) of Cpd-1, 2, 3) | 0.18 |
| Coupler dispersion medium (Cpd-5) | 0.03 |
| Coupler solvent (Equal amounts (vol.) of Solv-1, 2, 3) | 0.12 |
| Fifth Layer (Intermediate Layer) | |
| Gelatin | 1.00 |
| Anti-color mixing agent (Cpd-6) | 0.08 |
| Anti-color mixing agent solvent (Equal amounts (vol.) of Solv-4, 5) | 0.16 |
| Polymer latex (Cpd-7) | 0.10 |
| Sixth Layer (Low speed Green Sensitive Layer) | |
| Silver bromide (average grain size 0.25μ, size distribution 8%, octahedral) spectrally sensitized with the green sensitizing dye (ExS-4) | 0.04 |
| Silver chlorobromide (5 mol % AgCl, average grain size 0.40μ, size distribution 10%, octahedral) spectrally sensitized with the green sensitizing dye (ExS-4) | 0.06 |
| Gelatin | 0.80 |
| Magenta coupler (Equal amounts (wt.) of ExM-1, 2, 3) | 0.11 |
| Anti-staining agent (Cpd-8, 9, 10, 11; 10:7:7:1 (by wt.)) | 0.025 |
| Coupler dispersion medium (Cpd-5) | 0.05 |
| Coupler solvent (Equal amounts (vol.) of Solv-4, 6) | 0.15 |
| Seventh Layer (High Speed Green Sensitive Layer) | |
| Silver bromide (average grain size 0.65μ, size distribution 16%, octahedral) spectrally sensitized with the green sensitizing dye (ExS-4) | 0.10 |
| Gelatin | 0.80 |
| Magenta coupler (Equal amounts (wt.) of ExM-1, 2, 3) | 0.11 |
| Anti-staining agent (Cpd-8, 9, 10, 11; 10:7:7:1 (by wt.)) | 0.025 |
| Coupler dispersion medium (Cped-5) | 0.05 |
| Coupler solvent (Equal amounts (vol.) of Solv-4, 6) | 0.15 |
| Eighth Layer (Intermediate Layer) | |
| Same as the fifth layer. | |
| Ninth Layer (Yellow Filter Layer) | |
| Yellow colloidal silver | 0.12 |
| Geltain | 0.70 |
| Anti-color mixing agent (Cpd-6) | 0.03 |
| Anti-color mixing agent solvent (Equal amounts (vol.) of Sov-4, 5) | 0.10 |
| Polymer latex (Cpd-7) | 0.07 |
| Tenth Layer (Intermediate Layer) | |
| Same as the fifth layer. | |
| Eleventh Layer (Low Speed Blue Sensitive Layer) | |
| Silver bromide (average grain size 0.40μ, size distribution 8%, octahedral) spectrally sensitized with the blue sensitizing dyes (ExS-5, 6) | 0.07 |
| Silver chlorobromide (8 mol % AgCl, average grain size 0.60μ, size distribution 11%, octahedral) spectrally sensitized with the blue sensitizing dyes (ExS-5, 6) | 0.14 |
| Gelatin | 0.80 |
| Yellow coupler (Equal amounts (wt.) of ExY-1, 2) | 0.35 |
| Anti-staining agent (Cpd-4, 12; 1:5 (by wt.)) | 0.007 |
| Coupler disperion medium (Cpd-5) | 0.05 |
| Coupler solvent (Solv-2) | 0.10 |
| Twelfth Layer (High Speed Blue Sensitive Layer) | |
| Silver bromide (average grain size 0.85μ, size distribution 18%, octahedral) spectrally sensitized with the blue sensitizing dyes (ExS-5, 6) | 0.05 |
| Gelatin | 0.60 |
| Yellow coupler (Equal amounts (wt.) of ExY-1, 2) | 0.30 |
| Anti-staining agent (Cpd-4, 12; 1:5 (by wt.)) | 0.007 |
| Coupler dispersion medium (Cpd-5) | 0.05 |
| Coupler solvent (Solv-2) | 0.10 |
| Thirteenth Layer (Ultraviolet Absorbing Layer) | |
| Gelatin | 1.00 |
| Ultraviolet absorber (Equal amounts (wt.) of Cpd-2, 3, 13) | 0.50 |
| Anti-color fading agent (Equal amounts (wt.) of Cpd-6, 14) | 0.30 |
| Dispersion medium (Cpd-5) | 0.02 |
| Ultraviolet absorber solvent (Equal amounts (vol.) of Solv-2, 7) | 0.08 |
| Anti-irradiation dye (Cpd-15, 16, 17, 18, 23; 10:10:13:15:20 (by wt.)) | 0.05 |
| Fourteenth Layer (Protective Layer) | |
| Fine grained silver chloribromide (97 mol % AgCl, average size 0.1μ) | 0.03 |
| Acrylic modified copolymer of polyvinyl alcohol (17% modification) | 0.01 |
| Polymethyl methacrylate grains (avg. particle size 2.4μ) and silicon oxide (avg. particle | 0.05 |
| Gelatin | 1.80 |
| Gelatin hardening agent (Equal amounts (wt.) of H-1, H-2) | 0.18 |
| Fifteenth Layer (Backing Layer) | |
| Gelatin | 2.50 |
| Ultraviolet absorber (Equal amounts (wt.) of Cpd-2, 3, 13) | 0.50 |
| Dye (Equal amounts (wt.) of Cpd-15, 16, 17, 18, 23) | 0.06 |

Preparation of Emulsion EM-1

Aqueous solutions of potassium bromide (3.3 wt %) and silver nitrate (5 wt %) were added simultaneously under vigorous agitation over a period of 15 minutes at 75° C. to an aqueous gelatin (3.3 wt %) solution and an emulsion containing octahedral silver bromide grains of average grain size 0.40 μ were obtained. Then, 0.3 gram of 3,4-dimethyl-1,3-thiazolin-2-thione, 6 mg of sodium thiosulfate and 7 mg of chloroauric acid (tetra-hydrate) per mol of silver were added sequentially to the emulsion and a chemical sensitization treatment was carried out by heating at 75° C. for 80 minutes. The grains obtained in this way were then used as core grains which were grown under the same precipitation conditions as on the first occasion and ultimately an octahedral mono-disperse core/ shell silver bromide emulsion of average grain size 0.7 μ was obtained. The variation coefficient of the grain size was about 10%. 1.5 mg of sodium thiosulfate and 1.5 mg of chloroauric acid (tetra-hydrate) per mol of silver were added to the emulsion, chemical sensitization was carried out by heating at 60° C. for 60 minutes, and an internal latent image type silver halide emulsion was obtained.

ExZK-1 and ExZK-2 were used in amounts of $10^{-3}$ wt % and $10^{-2}$ wt % respectively as a nucleating agent and Cpd-19 was used in an amount of $10^{-2}$ wt % as a nucleation accelerator in each photosensitive layer. Moreover "Alkanol XC" (Dupont) and sodium alkylbenzenesulfonate were used in each layer in a total amount of 0.04 g/m$^2$ as emulsification and dispersing aids, and succinate ester and Magefac F-120 (Dainippon Ink Co.) were used in each layer in a total amount of 0.08 g/m$^2$ as coating aids. Cpd-20, 21 and 22 were used in each amount of 3 mg/m$^2$ as stabilizers in the silver halide and colloidal silver containing layers. The sample obtained was sample 101. The compounds used in this example are indicated below.

Cpd-1

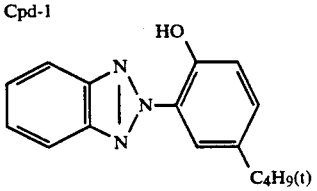

Cpd-2

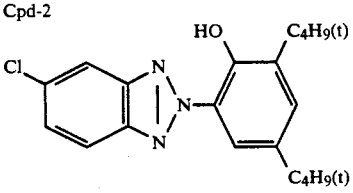

Cpd-3

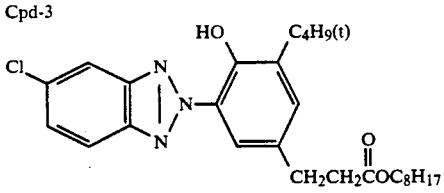

Cpd-4

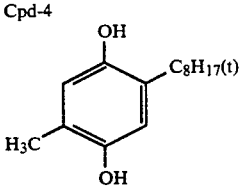

Cpd-5

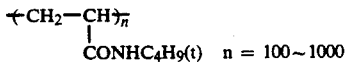

Cpd-6

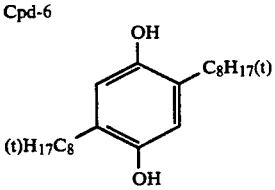

Cpd-7

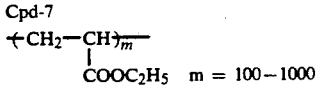

Cpd-8

-continued
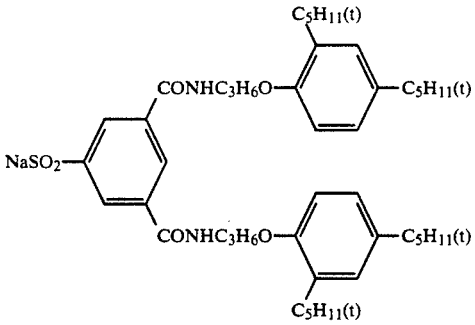
Cpd-9
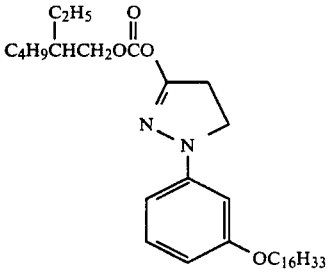
Cpd-10
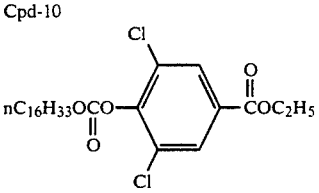
Cpd-11
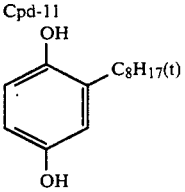
Cpd-12
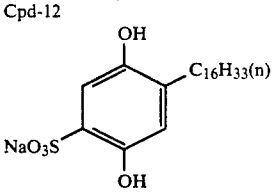
Cpd-13
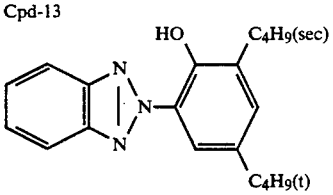
Cpd-14
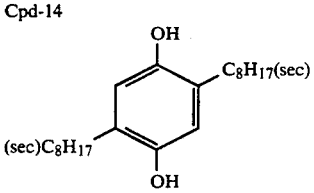
Cpd-15

-continued
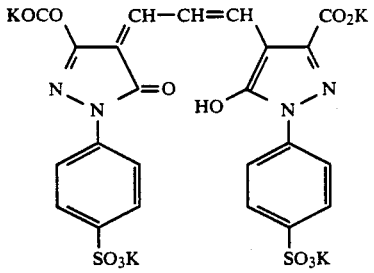
Cpd-16
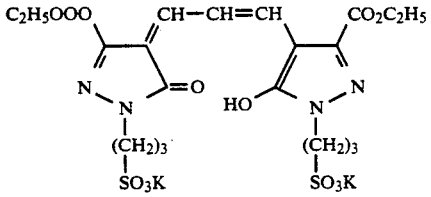
Cpd-17
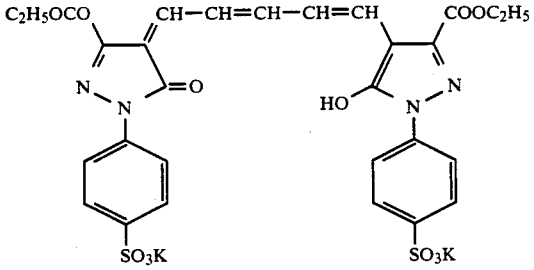
Cpd-18
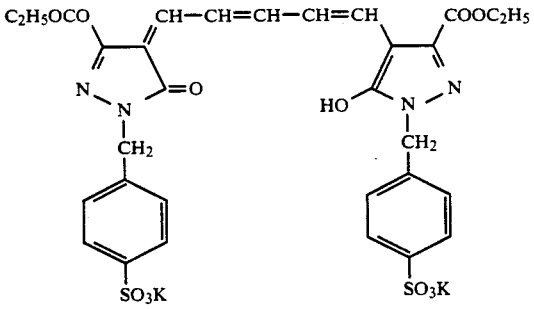
Cpd-19
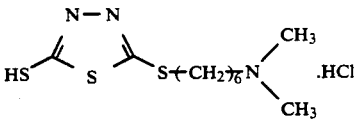
Cpd-20
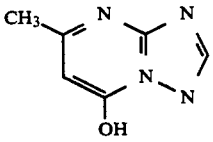
Cpd-21
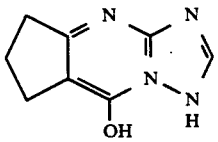

-continued
Cpd-22
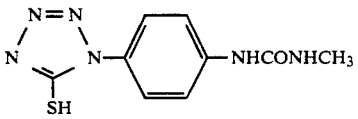
Cpd-23
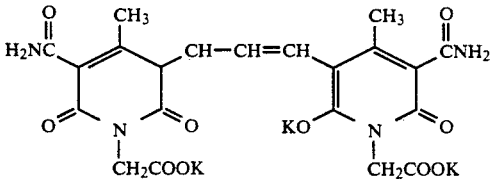
ExC-1
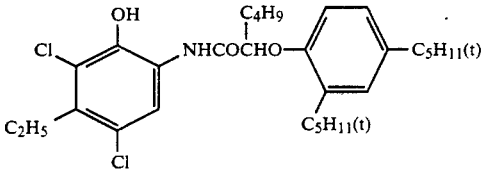
ExC-2
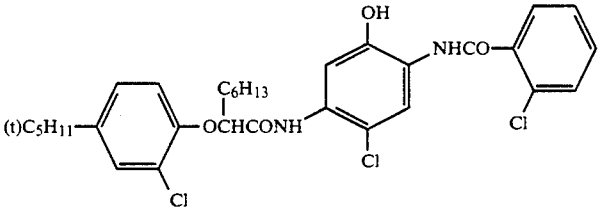
ExC-3
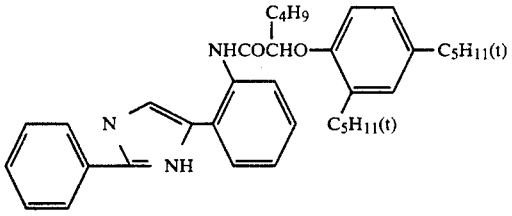
ExM-1
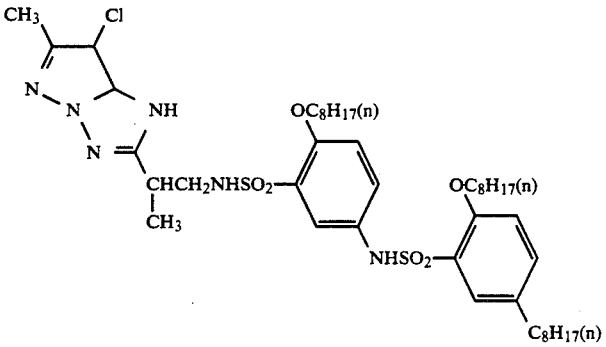
ExM-2

-continued
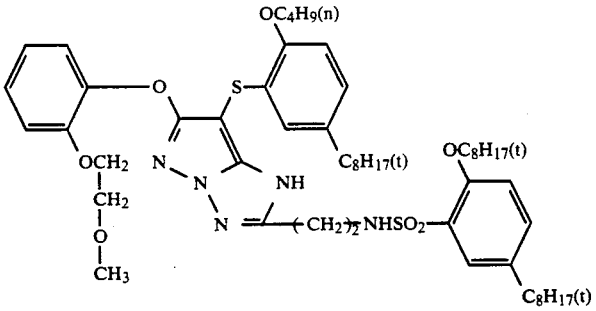
ExM-3
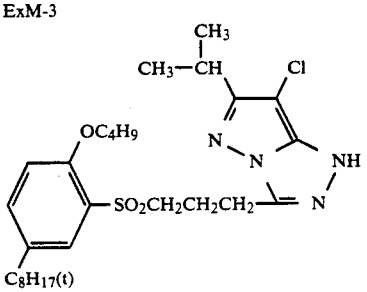
ExY-1
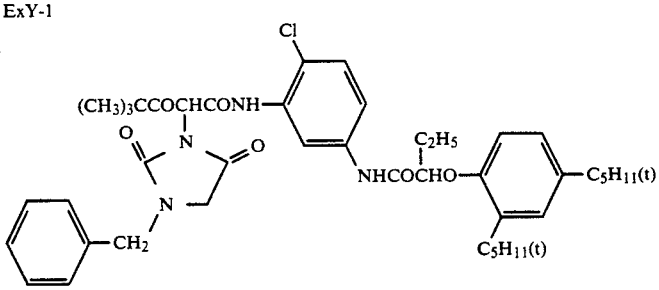
ExY-2
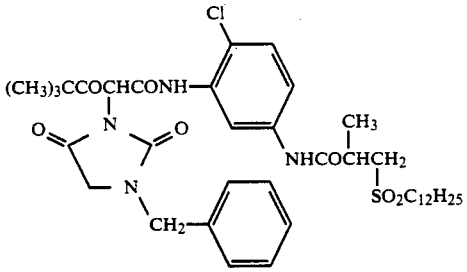
Solv-1
Di(2-ethylhexyl) sebacate
Solv-2
Trinonyl phosphate
Solv-3
Di-(3-methylhexyl) phthalate
Solv-4
Tricresyl phosphate
Solv-5
Dibutyl phthalate
Solv-6
Trioctyl phosphate
Solv-7
Di-(2-ethylhexyl) phthalate
H-1
1,2-Bis(vinylsulfonylacetamido)ethane -continued
H-2
4,6-Dichloro-2-hydroxy-1,3,5-triazine, sodium salt
ExZK-1
7-(3-Ethoxythiocarbonylaminobenzamido)-9-methyl-10-propargyl-1,2,3,4-tetrahydroacridinium trifluoro-methanesulfonate.
ExZK-2
2-[4-{3-[3-{3-[5-{3-[2-chloro-5-(1-dodecyloxy-carbonylethoxycarbonyl)phenylcarbamoyl]-4-hydroxy-1-naphthylthio}tetrazol-1-yl]phenyl}ureido]-benzene-sulfonamido}phenyl]-1-formylhydrazine
ExS-1
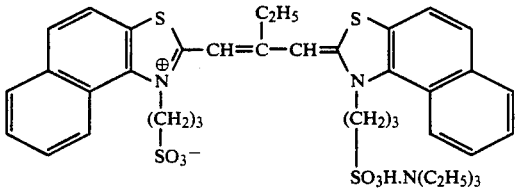
ExS-2
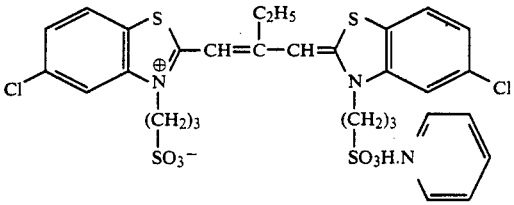
ExS-3
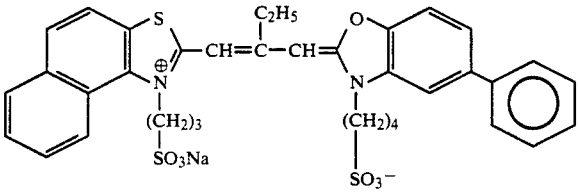
ExS-4
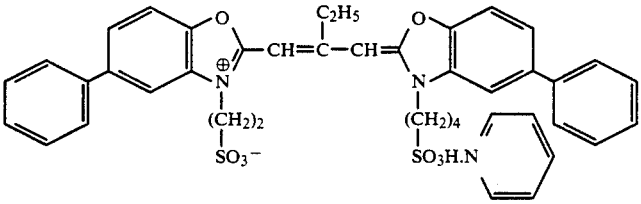
ExS-5
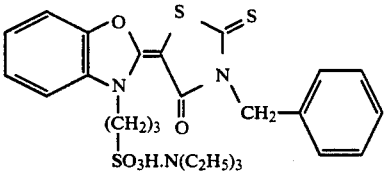
ExS-6
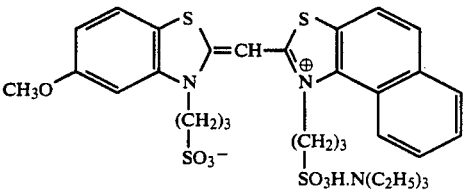

Samples 102–124 were prepared by adding the anti-color fading agents and additives shown in Table 1 to the sixth and seventh layers.

The amount of anti-color fading agent added was 0.15 g/m$^2$ in both the sixth and seventh layer. With the agent A-9 and A-16, the amount of A-9 and A-16 added was $9.0 \times 10^{-6}$ mol/m$^2$ in both the sixth and seventh layers.

TABLE 1

| Sample | Anti-color Fading Agent [II] | Additive [I] | Remarks |
|---|---|---|---|
| 102 | — | Comparative Cpd. B-1 | Comp. Ex. |
| 103 | — | Comparative Cpd. B-2 | Comp. Ex. |
| 104 | — | Comparative Cpd. B-3 | Comp. Ex. |
| 105 | — | This Invention, Cpd. (1) | Comp. Ex. |
| 106 | — | This Invention, Cpd. (2) | Comp. Ex. |
| 107 | — | This Invention, Cpd. (5) | Comp. Ex. |
| 108 | — | This Invention, Cpd. (8) | Comp. Ex. |
| 109 | — | This Invention, Cpd. (10) | Comp. Ex. |
| 110 | — | This Invention, Cpd. (22) | Comp. Ex. |
| 111 | Anti-color fading agent A-9 | Comparative Cpd. B-1 | Comp. Ex. |
| 112 | Anti-color fading agent A-16 | Comparative Cpd. B-2 | Comp. Ex. |
| 113 | Anti-color fading agent A-9 + A-16 | Comparative Cpd. B-3 | Comp. Ex. |
| 114 | Anti-color fading agent A-9 | This Invention, Cpd. (1) | Invention |
| 115 | Anti-color fading agent A-10 | This Invention, Cpd. (1) | Invention |
| 116 | Anti-color fading agent A-17 | This Invention, Cpd. (1) | Invention |
| 117 | Anti-color fading agent A-9 + A-16 | This Invention, Cpd. (1) | Invention |
| 118 | Anti-color fading agent A-8 | This Invention, Cpd. (5) | Invention |
| 119 | Anti-color fading agent A-9 | This Invention, Cpd. (5) | Invention |
| 120 | Anti-color fading agent A-10 | This Invention, Cpd. (5) | Invention |
| 121 | Anti-color fading agent A-5 | This Invention, Cpd. (8) | Invention |
| 122 | Anti-color fading agent A-6 | This Invention, Cpd. (10) | Invention |
| 123 | Anti-color fading agent A-7 | This Invention, Cpd. (22) | Invention |
| 124 | Anti-color fading agent A-9 + A-16 | This Invention, Cpd. (22) | Invention |

The known compounds indicated below were used for the comparative compounds B-1–B-3 indicated in Table 1 in the silver halide photographic materials.

(B-1)

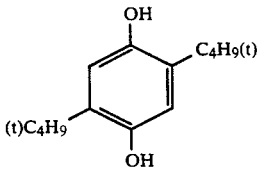

(Compound disclosed in JP-A-63-63033)

(B-2)

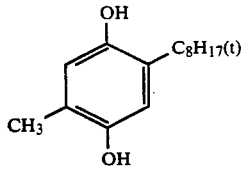

(Compound (1) disclosed in JP-A-52-146235)

(B-3)

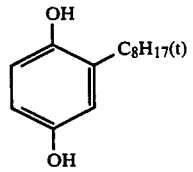

(Compound (d) disclosed in JP-A-49-106329)

The silver halide color photographic samples 101–124 prepared in the way described above were imagewise exposed (3200° K, 1/10th second, 10 CMS) and then processed continuously in an automatic processor using the method indicated below until the total bath replenishment was three times the tank capacity.

| Processing Operation | Time | Temperature | Parent Bath Capacity | Replenishment Amount |
|---|---|---|---|---|
| Color Development | 135 sec. | 38° C. | 15 liters | 300 ml/m$^2$ |
| Bleach-fix | 40 sec. | 38° C. | 3 liters | 300 ml/m$^2$ |
| Water Wash (1) | 40 sec. | 33° C. | 3 liters | — |
| Water Wash (2) | 40 sec. | 33° C. | 3 liters | 320 l/m$^2$ |
| Drying | 30 sec. | 80° C. | | |

The replenishment system for the water washing was a counter current replenishment system with replenishment of water washing bath (2) and transfer of the overflow from the water washing bath (2) to water washing bath (1). At this time, the carry-over amount of bleach-fixing solution into water washing tank (1) from the bleach-fix bath by the photosensitive material was 35 ml/m$^2$, and the amount of replenishment was 9.1 times the carry-over amount of bleach-fixing solution.

The composition of each processing bath is indicated below.

| | Parent Bath | Replenisher |
|---|---|---|
| Color Development Bath | | |
| D-Sorbitol | 0.15 gram | 0.20 gram |
| Sodium naphthalenesulfonate/formalin condensate | 0.15 gram | 0.20 gram |
| Ethylenediaminetetrakismethylene-phosphonic acid | 1.5 grams | 1.5 grams |
| Diethylene Glycol | 12.0 ml | 16.0 ml |
| Benzyl alcohol | 13.5 ml | 18.0 ml |
| Potassium bromide | 0.80 gram | — |
| Benzotriazole | 0.003 gram | 0.004 gram |
| Sodium sulfite | 2.4 grams | 3.2 grams |
| N,N-Bis(carboxymethyl)hydrazine | 6.0 grams | 8.0 grams |
| D-Glucose | 2.0 grams | 2.4 grams |
| Triethanolamine | 6.0 grams | 8.0 grams |
| N-Ethyl-N-(β-methanesulfonamido-ethyl)-3-methyl-4-aminoaniline sulfate | 6.4 grams | 8.5 grams |
| Potassium carbonate | 30.0 grams | 25.0 grams |
| Fluorescent whitener (Diamino-stilbene based) | 1.0 gram | 1.2 grams |
| Water to make up to | 1000 ml | 1000 ml |
| pH (25° C.) | 10.50 | 11.00 |
| Bleach Fix Bath | | |
| Ethylenediamine tetra-acetic acid, di-sodium salt | 4.0 grams | Same as Parent Bath |

-continued

| | Parent Bath | Replenisher |
|---|---|---|
| Ethylenediamine tetra-acetic acid Fe(III) ammonium salt di-hydrate | 70.0 grams | |
| Ammonium thiosulfate (700 g/l) | 180 ml | |
| Sodium p-toluenesulfinate | 20.0 grams | |
| Sodium bisulfite | 20.0 grams | |
| 5-Mercapto-1,3,4-triazole | 0.5 gram | |
| Ammonium nitrate | 10.0 gram | |
| Water to make up to | 1000 ml | |
| pH (25° C.) | 6.20 | |

Tap water was passed through a mixed bed type column which had been packed with an H-type strongly acidic cation exchange resin ("Amberlite IR-120B", made by Rohm and Haas) and an OH-type anion exchange resin ("Amberlite IR-400", made by the same company) and treated so that the calcium and magnesium ion concentrations were below 3 mg/l, after which 20 mg/l of sodium isocyanurate dichloride and 1.5 g/l of sodium sulfate were added. The pH of this liquid was within the range 6.5–7.5.

The magenta image densities of the samples obtained were measured and the results obtained are shown in Table 2.

TABLE 2

| Sample No. | Details | Toe Gradation*1 | Minimum Image Density $D_{min}$ | Maximum Image Density ($D_{max}$) As Processed | Maximum Image Density ($D_{max}$) After Color Mixing Test*2 |
|---|---|---|---|---|---|
| 101 | Comp. Ex. | 1.32 | 0.14 | 2.15 | 1.10 |
| 102 | Comp. Ex. | 1.80 | 0.12 | 2.20 | 1.50 |
| 103 | Comp. Ex. | 1.69 | 0.13 | 2.22 | 1.45 |
| 104 | Comp. Ex. | 1.75 | 0.12 | 2.21 | 1.55 |
| 105 | Comp. Ex. | 1.77 | 0.12 | 2.25 | 1.60 |
| 106 | Comp. Ex. | 2.20 | 0.11 | 2.30 | 1.48 |
| 107 | Comp. Ex. | 2.14 | 0.10 | 2.35 | 1.65 |
| 108 | Comp. Ex. | 2.30 | 0.11 | 2.25 | 1.70 |
| 109 | Comp. Ex. | 2.23 | 0.10 | 2.31 | 1.62 |
| 110 | Comp. Ex. | 2.19 | 0.10 | 2.26 | 1.58 |
| 111 | Comp. Ex. | 1.70 | 0.13 | 2.28 | 2.00 |
| 112 | Comp. Ex. | 1.75 | 0.12 | 2.33 | 1.95 |
| 113 | Comp. Ex. | 1.78 | 0.12 | 2.18 | 2.05 |
| 114 | Invention | 2.18 | 0.11 | 2.22 | 1.85 |
| 115 | Invention | 2.21 | 0.11 | 2.30 | 2.05 |
| 116 | Invention | 2.14 | 0.10 | 2.45 | 2.00 |
| 117 | Invention | 2.20 | 0.10 | 2.20 | 1.95 |
| 118 | Invention | 2.17 | 0.10 | 2.25 | 1.90 |
| 119 | Invention | 2.22 | 0.11 | 2.35 | 2.13 |
| 120 | Invention | 2.15 | 0.10 | 2.32 | 2.10 |
| 121 | Invention | 2.20 | 0.11 | 2.30 | 2.15 |
| 122 | Invention | 2.20 | 0.10 | 2.25 | 2.10 |
| 123 | Invention | 2.18 | 0.10 | 2.32 | 2.18 |
| 124 | Invention | 2.22 | 0.11 | 2.28 | 2.20 |

*1Average gradation from density $D_{min}$ + 0.1 to density $D_{min}$ + 0.6

*2Maximum density after continuous irradiation for 3 weeks with the sample located 30 cm from a 1 Kw Xe lamp It is clear from Table 2 that samples 114–124 of this invention have a hard toe gradation, and that they have excellent storage properties with little reduction of $D_{min}$.

EXAMPLE 2

Samples 202–216 were prepared by adding the anti-color fading agents shown in Table 3 to the eleventh and twelfth layers in the aforementioned sample 101.

TABLE 3

| Sample | Anti-color Fading Agent [II] | Additive [I] | Details |
|---|---|---|---|
| 202 | — | Comparative Cpd. B-1 | Comp. Ex. |
| 203 | — | Comparative Cpd. B-2 | Comp. Ex. |
| 204 | Anti-color fading agent A-14 | Comparative Cpd. B-1 | Comp. Ex. |
| 205 | Anti-color fading agent A-17 | Comparative Cpd. B-3 | Comp. Ex. |
| 206 | — | This Invention, Cpd. (1) | Comp. Ex. |
| 207 | — | This Invention, Cpd. (2) | Comp. Ex. |
| 208 | — | This Invention, Cpd. (12) | Comp. Ex. |
| 209 | — | This Invention, Cpd. (24) | Comp. Ex. |
| 210 | Anti-color fading agent A-14 | This Invention, Cpd. (1) | Invention |
| 211 | Anti-color fading agent A-14 | This Invention, Cpd. (2) | Invention |
| 212 | Anti-color fading agent A-14 | This Invention, Cpd. (12) | Invention |
| 213 | Anti-color fading agent A-15 | This Invention, Cpd. (1) | Invention |
| 214 | Anti-color fading agent A-15 | This Invention, Cpd. (2) | Invention |
| 215 | Anti-color fading agent A-15 | This Invention, Cpd. (5) | Invention |
| 216 | Anti-color fading agent A-15 | This Invention, Cpd. (8) | Invention |

The amount of anti-color fading agent added was set at 0.10 g/m$^2$ in both the eleventh and twelfth layers. The amount of additive was $2.2\times10^{-5}$ mol/m$^2$ in both the eleventh and twelfth layers.

The yellow colored image densities were measured after processing in the same way as in example 1, and the results obtained are shown in Table 4.

TABLE 4

| Sample No. | Details | Fresh Bath Toe Grad.*1 | Fresh Bath $D_{min}$ | Running Bath Toe Grad. | Running Bath $D_{min}$ | $D_{max}$ (in fresh bath) As Processed | $D_{max}$ (in fresh bath) After Anti-color Fading |
|---|---|---|---|---|---|---|---|
| 201 | Comp. Ex. | 1.50 | 0.14 | 1.45 | 0.14 | 2.38 | 1.55 |
| 202 | Comp. Ex. | 1.70 | 0.12 | 1.31 | 0.13 | 2.40 | 1.60 |
| 203 | Comp. Ex. | 1.60 | 0.13 | 1.25 | 0.13 | 2.35 | 1.90 |
| 204 | Comp. Ex. | 1.79 | 0.12 | 1.32 | 0.13 | 2.32 | 2.00 |
| 205 | Comp. Ex. | 1.67 | 0.12 | 1.28 | 0.13 | 2.41 | 1.53 |
| 206 | Comp. Ex. | 2.31 | 0.10 | 2.15 | 0.11 | 2.30 | 1.62 |
| 207 | Comp. Ex. | 2.25 | 0.11 | 2.08 | 0.11 | 2.45 | 1.70 |
| 208 | Comp. Ex. | 2.30 | 0.10 | 2.12 | 0.11 | 2.37 | 1.65 |
| 209 | Comp. Ex. | 2.14 | 0.10 | 2.01 | 0.11 | 2.40 | 1.63 |
| 210 | Invention | 2.23 | 0.10 | 2.13 | 0.10 | 2.35 | 2.15 |
| 211 | Invention | 2.26 | 0.11 | 2.11 | 0.11 | 2.38 | 2.20 |
| 212 | Invention | 2.19 | 0.10 | 2.06 | 0.11 | 2.41 | 2.25 |
| 213 | Invention | 2.25 | 0.11 | 2.15 | 0.11 | 2.33 | 2.13 |
| 214 | Invention | 2.28 | 0.10 | 2.15 | 0.10 | 2.35 | 2.10 |
| 215 | Invention | 2.30 | 0.10 | 2.17 | 0.11 | 2.40 | 2.25 |
| 216 | Invention | 2.21 | 0.11 | 2.06 | 0.11 | 2.41 | 2.20 |

*1Same as in Table 2.

*2Maximum density measured after storing the samples for 6 days at 100° C.

It is clear from Table 4 that samples 210–216 of this invention have a hard toe gradation and have excellent base whiteness and good storage properties. Furthermore, on looking at the photographic performance after continuous processing, the toe gradation became softer with samples 202–205 to which comparative compounds had been added, but there was virtually no change with samples 201–216 of the present invention and there was little deterioration of the processing bath.

EXAMPLE 3

A multi-layer printing paper of which the layer structure indicated below was prepared on a paper support which had been laminated on both sides with polyethylene. The coating liquids were prepared in the way described below.

Preparation of the First Layer Coating Liquid

Ethyl acetate (27.2 cc) and 4.1 grams each of solvent (Solv-33) and solvent (Solv-36) were added to 19.1 grams of the yellow coupler (ExY) and the solution obtained was emulsified and dispersed in 185 cc of 10 wt % aqueous gelatin solution which contained 8 cc of 10 wt % aqueous solution of sodium dodecylbenzenesulfonate. Also, a silver chlorobromide emulsion (a mixture in the proportions 1 : 3 by mol (as silver) of an cubic emulsion of silver bromide content 80.0 mol %, cubic, average grain size 0.85 μ and variation coefficient 0.08 and a cubic emulsion of silver bromide content 80.0 mol %, average grain size 0.62 μ and variation coefficient 0.07) was treated with sulfur sensitization and then $5.0\times10^{-4}$ mol per mol of silver of the blue sensitizing dye indicated below was added. The aforementioned emulsified dispersion and this emulsion were mixed together to provide the first layer coating liquid which had the composition indicated below. The coating liquids for the second to the seventh layers were prepared in the same way as the first layer coating liquid. 1-Oxy-3,5-dichloro-s-triazine, sodium salt, was used as a gelatin hardening agent in each layer. The compounds indicated below were used as the spectral sensitizing dyes in each layer.

Blue Sensitive Emulsion Layer

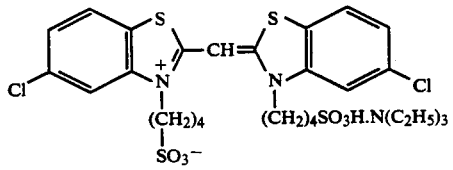

($5.0 \times 10^{-4}$ mol per mol of silver halide)

Green Sensitive Emulsion Layer

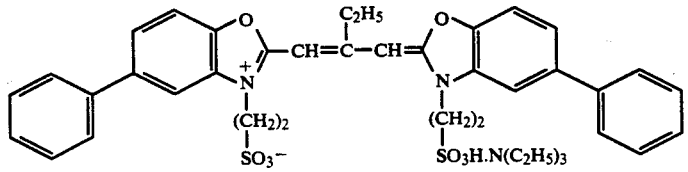

($5.0 \times 10^{-4}$ mol per mol of silver halide)

and

-continued

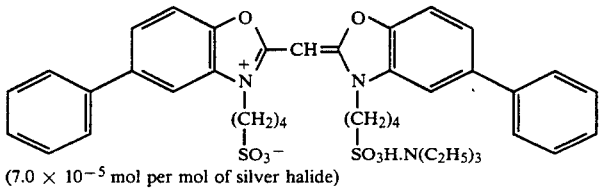

(7.0 × $10^{-5}$ mol per mol of silver halide)

Red Sensitive Emulsion Layer

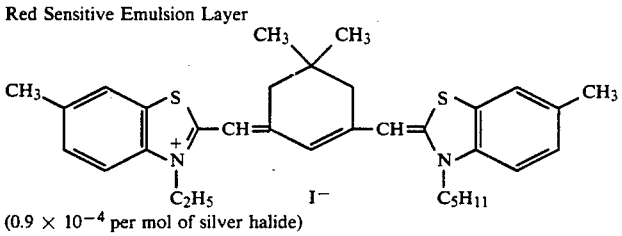

(0.9 × $10^{-4}$ per mol of silver halide)

The compound indicated below was added to the red sensitive emulsion layer in an amount of $2.6\times10^{-4}$ mol per mol of silver halide.

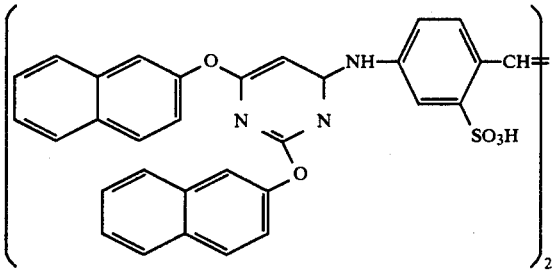

Furthermore, 1-(5-methylureidophenyl]-5-mercaptotetrazole was added in an amount of $4.0\times10^{-4}$ mol, $3.0\times10^{-3}$ mol and $1.0\times10^{-5}$ mol, per mol of silver halide, and 2-methyl-5-tert-octylhydroquinone was added in an amount of $8\times10^{-3}$ mol, $2\times10^{-2}$ mol and $2\times10^{-2}$ mol, per mol of silver halide, to the blue, green and red sensitive emulsion layers respectively.

4-Hydroxy-6-methyl-1,3,3a,7-tetra-azaindene was added in an amount of $1.2\times10^{-2}$ mol and $1.1\times10^{-2}$ mol, per mol of silver halide, to the blue and green sensitive emulsion layers respectively.

The equimolar dye mixture indicated below were added in an amount of 0.05 g/m$^2$ to the sixth layer shown below for anti-irradiation purposes.

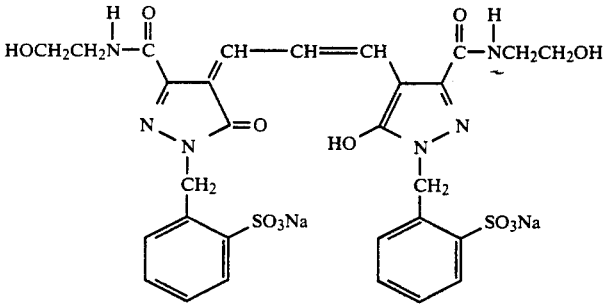

and

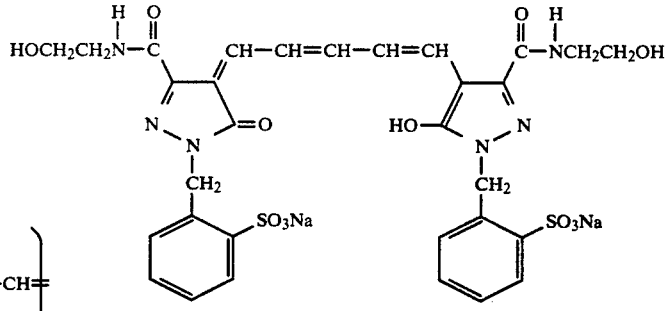

Layer Structure

The composition of each layer is indicated below. The numerical values indicate coated amounts (g/m$^2$). In the case of silver halide emulsions the coated amount shown is the coated amount calculated as silver.

Support

Polyethylene laminated paper
[White pigment ($TiO_2$) and blue dye (ultramarine) included in the polyethylene on the first layer side]

-continued

| | |
|---|---|
| First Layer (Blue Sensitive Layer) | |
| The aforementioned silver chlorobromide emulsion (AgBr: 80 mol %) | 0.26 |
| Gelatin | 1.83 |
| Yellow coupler (ExY) | 0.83 |
| Coupler dispersion medium (Cpd-32) | 0.08 |
| Solvent (Solv-36) | 0.18 |
| Second Layer (Anti-color Mixing Layer) | |
| Gelatin | 0.99 |
| Anti-color mixing agent (Cpd-31) | 0.08 |
| Solvent (Solv-31) | 0.16 |
| Solvent (Solv-34) | 0.08 |
| Third Layer (Green Sensitive Layer) | |
| Silver chlorobromide emulsion (a mixture in the proportions (as silver) 1:1 by mol of an emulsion of AgBr content 90 mol %, cubic, average grain size 0.47μ, variation coefficient 0.12 and an emulsion of AgBr content 90 mol %, cubic, average grain size 0.36μ, variation coefficient 0.09) | 0.16 |
| Gelatin | 1.79 |
| Magenta coupler (ExM) | 0.32 |
| Ultraviolet absorber (UV-1) | 0.47 |
| Anti-staining agent (Cpd-33) | 0.03 |
| Anti-staining agent (Cpd-34) | 0.04 |
| Solvent (Solv-32) | 0.65 |
| Fourth Layer (Ultraviolet Absorbing Layer) | |
| Gelatin | 1.58 |
| Ultraviolet absorber (UV-1) | 0.47 |
| Anti-color mixing agent (Cpd-31) | 0.05 |
| Solvent (Solv-35) | 0.24 |
| Fifth Layer (Red Sensitive Layer) | |
| Silver chlorobromide emulsion (a mixture in the proportions (as silver) 1:2 by mol of an emulsion of AgBr content 70 mol %, cubic, average grain size 0.49μ, variation coefficient 0.08 and an emulsion of AgBr content 70 mol %, cubic, average grain size 0.34μ, variation coefficient 0.10) | 0.23 |
| Gelatin | 1.34 |
| Cyan coupler (ExC) | 0.30 |
| Coupler dispersion medium (Cpd-32) | 0.17 |
| Anti-staining agent (Cpd-33) | 0.40 |
| Solvent (Solv-36) | 0.20 |
| Comparative compounds, compounds of this invention | See Table 6 |
| Sixth Layer (Ultraviolet Absorbing Layer) | |
| Gelatin | 0.53 |
| Ultraviolet absorber (UV-1) | 0.16 |
| Anti-color mixing agent (Cpd-31) | 0.02 |
| Solvent (Solv-35) | 0.08 |
| Seventh Layer (Protective Layer) | |
| Gelatin | 1.33 |
| Acrylic modified poly(vinyl alcohol) copolymer (17% modification) | 0.17 |
| Liquid paraffin | 0.03 |

(Cpd-31) Anti-color Mixing Agent

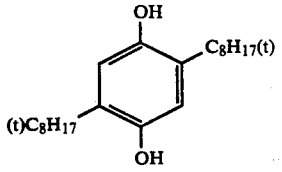

(Cpd-32) Coupler Dispersion Medium $\leftarrow CH_2-CH\rightarrow_n$
$\quad\quad |$
$\quad\quad CONHC_4H_9(t)$ Average molecular weight 80,000

(Cpd-33) Anti-staining Agent

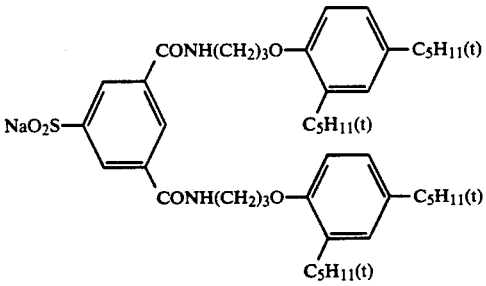

(Cpd-34) Anti-staining Agent

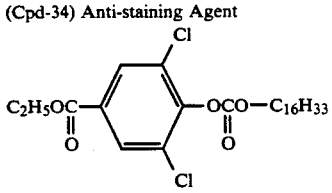

(UV-1) Ultraviolet Absorber

A 4:2:4 (by weight) mixture of:

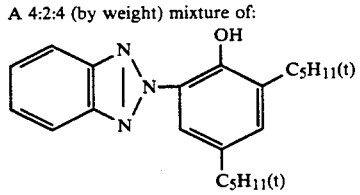

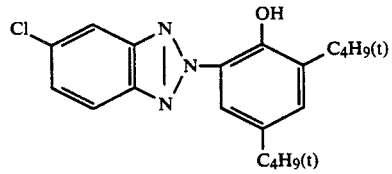

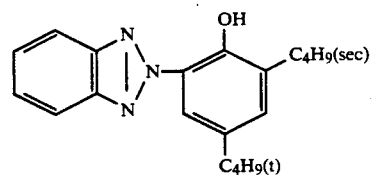

(Solv-31) Solvent

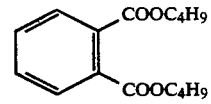

(Solv-32) Solvent

A 2:1 (by volume) mixture of:

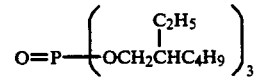

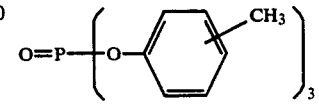

(Solv-33) Solvent $O=P\leftarrow O-C_9H_{19}(iso))_3$ (Solv-34) Solvent

-continued

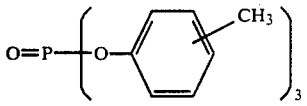

(Solv-35) Solvent

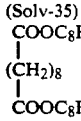

(Solv-36) Solvent

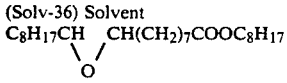

(ExY) Yellow Coupler

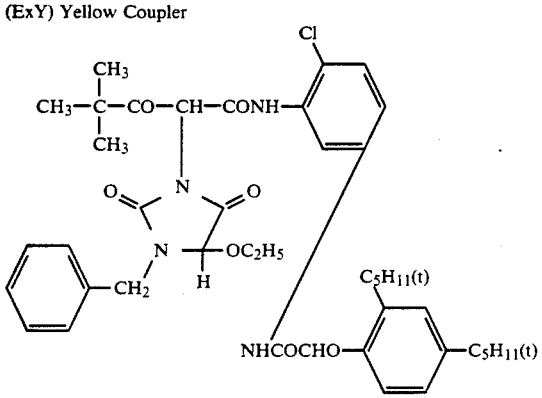

(ExM) Magenta Coupler

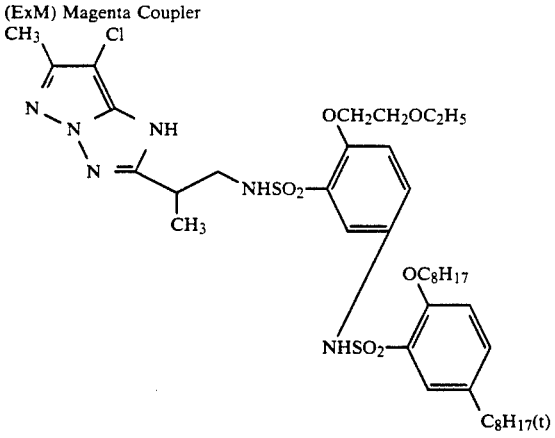

(ExC) Cyan Coupler
A 1:1 (mol ratio) mixture of:

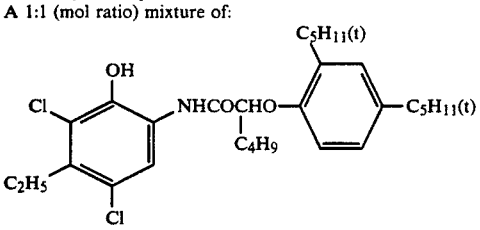

-continued and

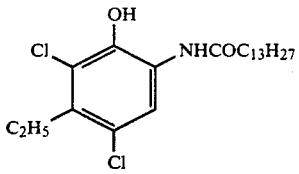

The samples A to L obtained in this way (see table 6) were exposed through an optical wedge and then processed using the operations indicated below.

| Processing Operation | Temperature | Time |
|---|---|---|
| Color Development | 37° C. | 3 min. 30 sec. |
| Bleach-fix | 33° C. | 1 min. 30 sec. |
| Water Wash | 24–34° C. | 3 minutes |
| Drying | 70–80° C. | 1 minute |

| | |
|---|---|
| Color Development Bath | |
| Water | 800 ml |
| Diethylenetriamine penta-acetic acid | 1.0 gram |
| Nitrilo-triacetic acid | 2.0 grams |
| Benzyl alcohol | 15 ml |
| Diethylene glycol | 10 ml |
| Sodium sulfite | 2.0 grams |
| Potassium bromide | 1.0 gram |
| Potassium carbonate | 30 grams |
| N-Ethyl-N-(β-methanesulfonamidoethyl)-3-methyl-4-aminoaniline sulfate | 4.5 grams |
| Hydroxylamine sulfate | 3.0 grams |
| Fluorescent whitener (Whitex 4B, made by Sumitomo Chemical) | 1.0 gram |
| Water to make up to | 1000 ml |
| pH (25° C.) | 10.25 |
| Bleach-Fix Bath | |
| Water | 400 ml |
| Ammonium thiosulfate (70 wt %) | 150 ml |
| Sodium sulfite | 18 grams |
| Ethylenediamine tetra-acetic acid, Fe(III) Ammonium salt | 55 grams |
| Ethylenediamine tetra-acetic acid, di sodium salt | 5 grams |
| Water to make up to | 1000 ml |
| pH (25° C.) | 6.70 |

The photographs were evaluated with respect to minimum density ($D_{min}$) and gradation. The gradation is shown as the average gradation from $D_{min}+0.1$ to $D_{min}+0.6$.

The results obtained are shown in Table 5.

TABLE 5

| Sample No. | Details | Additive*1 [I] | Anti-color Fading Agent [II]*2 | $D_{min}$ | Gradation | $D_{max}$ As Processed | $D_{max}$ After Color Fading Test*3 |
|---|---|---|---|---|---|---|---|
| 301 | Comp. Ex. | — | — | 0.14 | 1.66 | 2.40 | 1.25 |
| 302 | Comp. Ex. | B-1 | — | 0.13 | 1.62 | 2.38 | 1.55 |
| 303 | Comp. Ex. | B-2 | — | 0.13 | 1.58 | 2.51 | 1.60 |
| 304 | Comp. Ex. | B-3 | — | 0.14 | 1.57 | 2.48 | 1.63 |
| 305 | Comp. Ex. | (1) | — | 0.11 | 2.11 | 2.51 | 1.80 |

TABLE 5-continued

| Sample No. | Details | Additive*1 [I] | Anti-color Fading Agent [II]*2 | $D_{min}$ | Gradation | $D_{max}$ As Processed | $D_{max}$ After Color Fading Test*3 |
|---|---|---|---|---|---|---|---|
| 306 | Comp. Ex. | (8) | — | 0.11 | 2.21 | 2.45 | 1.76 |
| 307 | Comp. Ex. | (9) | — | 0.12 | 2.23 | 2.55 | 1.83 |
| 308 | Comp. Ex. | (10) | — | 0.11 | 2.19 | 2.52 | 1.84 |
| 309 | Comp. Ex. | (19) | — | 0.11 | 2.18 | 2.43 | 1.73 |
| 310 | Comp. Ex. | (23) | — | 0.11 | 2.20 | 2.49 | 1.88 |
| 311 | Comp. Ex. | B-1 | A-1 | 0.13 | 1.66 | 2.38 | 2.10 |
| 312 | Comp. Ex. | B-1 | A-9 | 0.14 | 1.62 | 2.51 | 2.23 |
| 313 | Comp. Ex. | B-2 | A-10 | 0.13 | 1.58 | 2.50 | 2.18 |
| 314 | Invention | (1) | A-1 | 0.11 | 2.12 | 2.43 | 2.27 |
| 315 | Invention | (2) | A-1 | 0.11 | 2.15 | 2.49 | 2.30 |
| 316 | Invention | (8) | A-5 | 0.12 | 2.20 | 2.50 | 2.28 |
| 317 | Invention | (9) | A-6 | 0.11 | 2.19 | 2.51 | 2.30 |
| 318 | Invention | (14) | A-6 | 0.12 | 2.18 | 2.52 | 2.31 |
| 319 | Invention | (19) | A-7 | 0.10 | 2.20 | 2.50 | 2.29 |
| 320 | Invention | (22) | A-10 | 0.10 | 2.13 | 2.55 | 2.30 |
| 321 | Invention | (1) | A-11 | 0.10 | 2.17 | 2.45 | 2.27 |
| 322 | Invention | (1) | A-12 | 0.11 | 2.16 | 2.43 | 2.26 |
| 323 | Invention | (8) | A-13 | 0.12 | 2.19 | 2.51 | 2.25 |
| 324 | Invention | (8) | A-14 | 0.12 | 2.14 | 2.38 | 2.17 |
| 325 | Invention | (24) | A-16 | 0.12 | 2.18 | 2.44 | 2.22 |

*1 5.0 mol % with respect to coupler added.
*2 Added in an amount equimolar with the coupler
*3 $D_{max}$ after continuous irradiation for 3 weeks with the sample located 30 cm from a 1 Kw Xe lamp.

It is clear from Table 5 that samples 314–325 of this invention had good gradation and good storage properties.

EXAMPLE 4

Photosensitive materials were prepared in the same way as in Example 1 except that the anti-color mixing agent (Cpd-5) in the second layer (anti-color mixing layer) was replaced by equimolar amounts of the compounds shown in Table 6, and these samples were then processed in the same way as described in Example 1.

Photographic characteristics were evaluated with respect to minimum density ($D_{min}$) and the maximum density ($D_{max}$) of the magenta image part. Furthermore, the extent of color mixing was evaluated by the yellow density at the point which had a density of 1.0 in the magenta image.

The results obtained are shown in Table 6.

TABLE 6

| Sample No. | Comparative Compound & Cpd. of the Invention | Photographic Characteristics $D_{min}$ | $D_{max}$ | D B/G* | Remarks |
|---|---|---|---|---|---|
| A | — | 0.14 | 2.25 | 0.32 | Comparative Ex. |
| B | B-1 | 0.13 | 2.39 | 0.18 | Comparative Ex. |
| C | B-2 | 0.14 | 2.42 | 0.16 | Comparative Ex. |
| D | B-3 | 0.14 | 2.41 | 0.18 | Comparative Ex. |
| E | (1) | 0.11 | 2.49 | 0.08 | This Invention |
| F | (2) | 0.12 | 2.48 | 0.07 | This Invention |
| G | (6) | 0.12 | 2.49 | 0.07 | This Invention |
| H | (8) | 0.10 | 2.48 | 0.08 | This Invention |
| I | (9) | 0.11 | 2.49 | 0.07 | This Invention |
| J | (18) | 0.12 | 2.49 | 0.07 | This Invention |
| K | (19) | 0.10 | 2.48 | 0.08 | This Invention |
| L | (20) | 0.12 | 2.49 | 0.07 | This Invention |

*The extent of color mixing evaluated by the yellow density at the point which had a density of 1.0 in the magenta image.

It is clear from Table 6 that when compounds of general formula [I] of this invention are used as anti-color mixing agents the storage properties are good and an excellent base whiteness is obtained. Moreover, color mixing can be prevented effectively without reducing the color forming properties.

EXAMPLE 5

A multi-layer printing paper of which the layer structure is indicated below was prepared on a paper support which had been laminated on both sides with polyethylene. The coating liquids were prepared in the way described below.

Preparation of the First Layer Coating Liquid

Ethyl acetate (27.2 cc) and 8.2 grams of solvent (Solv-53) were added to 19.1 grams of the yellow coupler (ExY*), and the solution obtained was emulsified and dispersed in 185 cc of 10 wt % aqueous gelatin solution which contained 8 cc of 10 wt % aqueous solution of sodium dodecylbenzenesulfonate. Also, to a silver chlorobromide emulsion (cubic, average grain size 0.85 μ and variation coefficient 0.07 with 1 mol % silver bromide as a percentage of the whole present locally on part of the grain surface) $2.0\times10^{-4}$ mol per mol of silver of each of two types of blue sensitizing dye indicated below were added and then carrying out sulfur sensitization. The aforementioned emulsified dispersion and this emulsion was mixed together to provide the first layer coating liquid which had the composition indicated below. The coating liquids for the second to the seventh layers were prepared in the same way as the first layer coating liquid. 1-Oxy-3,5-dichloro-s-triazine, sodium salt, was used as a gelatin hardening agent in each layer. The compounds indicated below were used as the spectrally sensitizing dyes in each layer.

Blue Sensitive Emulsion Layer

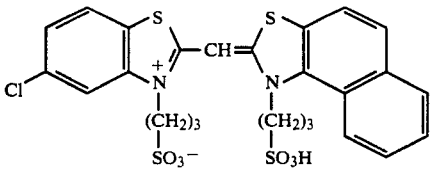

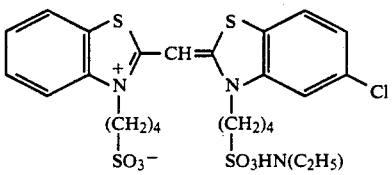

($2.0 \times 10^{-4}$ mol per mol of silver halide of each)

Green Sensitive Emulsion Layer

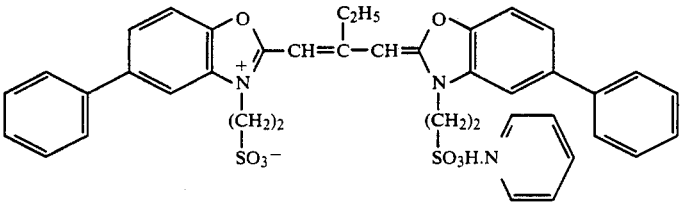

($4.0 \times 10^{-4}$ mol per mol of silver halide)

and

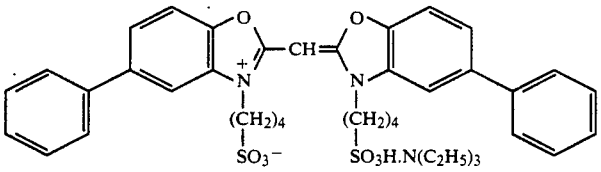

($7.0 \times 10^{-5}$ mol per mol of silver halide)

Red Sensitive Emulsion Layer

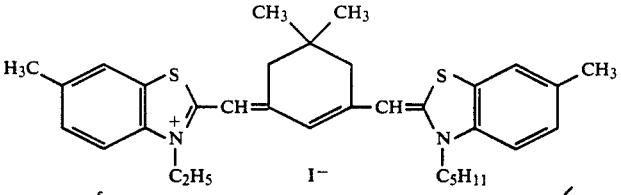

($7.0 \times 10^{-5}$ per mol of silver halide)

The compound indicated below was added to the red sensitive emulsion layer in an amount of $2.6 \times 10^{-3}$ mol per mol of silver halide.

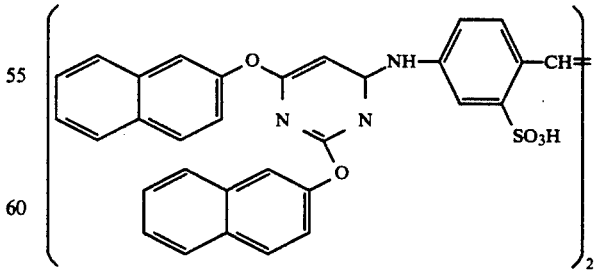

Furthermore, 1-(5-methylureidophenyl)-5-mercaptotetrazole was added in an amount of $8.5 \times 10^{-5}$ mol, $7.7 \times 10^{-4}$ mol and $2.5 \times 10^{-4}$ mol, per mol of the silver halide to the blue, green and red sensitive emulsion layers, respectively.

The equimolar dye mixture indicated below were added in an amount of 0.05 g/m$^2$ to the sixth layer shown below to prevent irradiation.

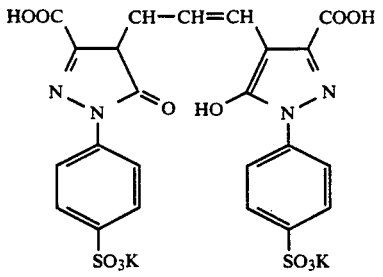

and

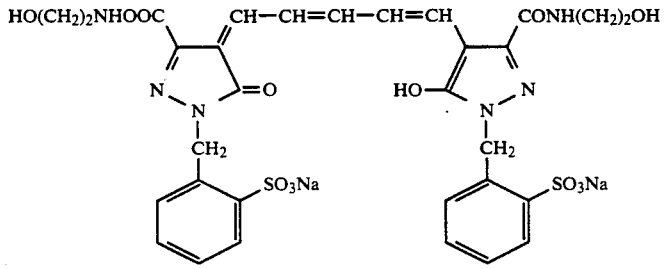

Layer Structure

The composition of each layer is indicated below.

The numerical values indicated coated amounts (g/m$^2$). In the case of silver halide emulsions the coated amount shown is the coated amount calculated as silver.

| | |
|---|---|
| Support | |
| Polyethylene laminated paper | |
| [White pigment ($TiO_2$) and blue dye (ultramarine) included in the polyethylene on the first layer side] | |
| First Layer (Blue Sensitive Layer) | |
| The aforementioned silver chlorobromide emulsion (AgBr: 80 mol %) | 0.30 |
| Gelatin | 1.86 |
| Yellow coupler (ExY*) | 0.82 |
| Coupler dispersion medium (Cpd-52) | 0.03 |
| Solvent (Solv-53) | 0.35 |
| Second Layer (Anti-color Mixing Layer) | |
| Gelatin | 0.99 |
| Anti-color mixing agent (Cpd-51) | 0.08 |
| Solvent (Solv-51) | 0.16 |
| Solvent (Solv-54) | 0.08 |
| Third Layer (Green Sensitive Layer) | |
| Silver chlorobromide emulsion (Cubic, average grain size 0.40μ, variation coefficient 0.09 with 1 mol % AgBr as percentage of the whole of the grains present locally on part of the grain surface) | 0.2 |
| Gelatin | 1.24 |
| Magenta coupler (ExM*) | 0.31 |
| Colored image stabilizer of this invention | See Table 7 |
| Comparative compound or compound [I] of the invention | See Table 7 |
| Solvent (Solv-52) | 0.42 |
| Fourth Layer (Ultraviolet Absorbing Layer) | |
| Gelatin | 1.58 |
| Ultraviolet absorber (UV-1) | 0.47 |
| Anti-color mixing agent (Cpd-51) | 0.05 |
| Solvent (Solv-55) | 0.24 |
| Fifth Layer (Red Sensitive Layer) | |
| Silver chlorobromide emulsion (cubic, average grain size 0.36μ, variation coefficient 0.11 with 1.6 mol % AgBr as percentage of the whole of the grains present locally on part of the grain surface) | 0.21 |
| Gelatin | 1.34 |
| Cyan coupler (ExC*) | 0.34 |
| Coupler dispersion medium (Cpd-52) | 0.17 |
| Ultraviolet absorber (UV-1) | 0.34 |
| Solvent (Solv-54) | 0.37 |

-continued

| | |
|---|---|
| Sixth Layer (Ultraviolet Absorbing Layer) | |
| Gelatin | 0.53 |
| Ultraviolet absorber (UV-1) | 0.16 |
| Anti-color mixing agent (Cpd-51) | 0.02 |
| Solvent (Solv-55) | 0.08 |
| Seventh Layer (Protective Layer) | |
| Gelatin | 1.33 |
| Acrylic modified poly(vinyl alcohol) copolymer (17% modification) | 0.17 |
| Liquid paraffin | 0.03 |

(ExY*) Yellow Coupler

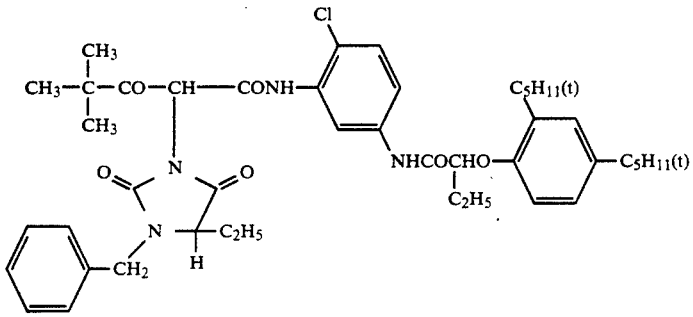

(ExM*) Magenta Coupler

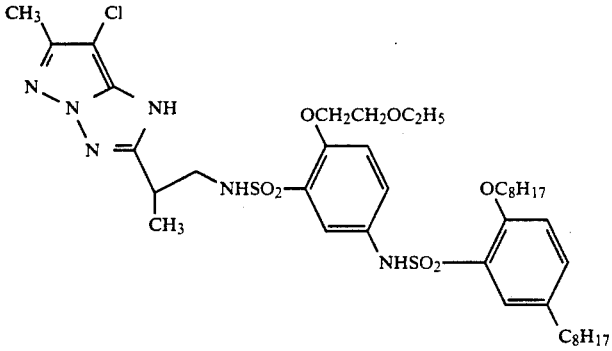

(ExC*) Cyan Coupler

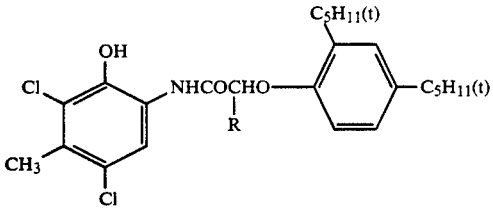

A 1:3:6 (by weight) mixture of compounds with R = H, $C_2H_5$, and $C_4H_9$ (Cpd-51) Anti-color Mixing Agent

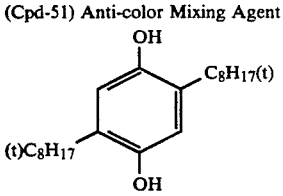

(Cpd-52) Coupler Dispersion Medium

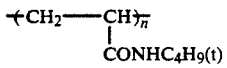

Average molecular weight 60,000

(UV-1) Ultraviolet Absorber

A 4:2:4 (by weight) mixture of:

-continued

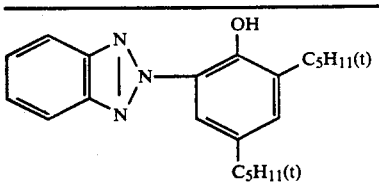

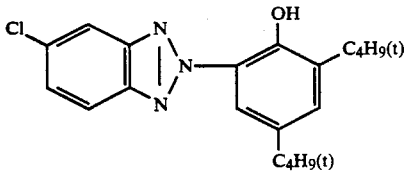

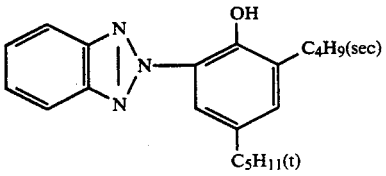

(Solv-51) Solvent

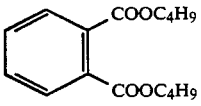

(Solv-52) Solvent
A 1:1 (by weight) mixture of:

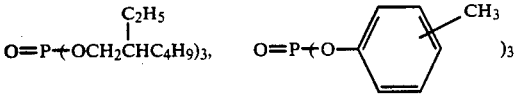

(Solv-53) Solvent
$O{=}P{\leftarrow}O{-}C_9H_{19}(iso))_3$ (Solv-54) Solvent

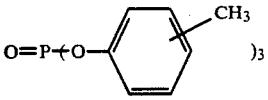

(Solv-55) Solvent
$COOC_8H_{17}$
|
$(CH_2)_8$
|
$COOC_8H_{17}$

Samples 401–435 obtained in the way described above (see Table 7) were exposed imagewise and then processed continuously (in a running test) in a paper processor ("Lucky Image Processor" CP-303H (made by Fujimoto Shashin Kogyo K. K.) below until the system had been replenished to twice the capacity of the color development tank.

| Processing Operation | Temperature | Time | Replenishment Amount* | Tank Capacity |
|---|---|---|---|---|
| Color Development | 35° C. | 45 sec. | 16.1 ml | 1.7 liters |
| Bleach-fix | 30–35° C. | 45 sec. | 21.5 ml | 1.7 liters |
| Rinse | 30–35° C. | 60 sec. | | 1.7 liters |
| Drying | 70–80° C. | 60 sec. | | |

*Amount Per square meter of photosensitive material. (Four tank counter-current system from rinse tank (3) to rinse tank (1))

The composition of each processing bath was as indicated below:

| Color Development Bath | Parent Bath | Replenisher |
|---|---|---|
| Water | 800 ml | 800 ml |
| Ethylenediamine-N,N,N,N-tetramethylenephosphonic acid | 1.5 grams | 2.0 grams |
| Triethanolamine | 8.0 grams | 12.0 grams |
| Sodium chloride | 1.4 grams | — |
| Potassium carbonate | 25 grams | 25 grams |
| N-Ethyl-N-(β-methanesulfonamidoethyl)-3-methyl-4-aminoaniline sulfate | 5.0 grams | 7.0 grams |
| N,N-Bis(carboxymethyl)hydrazine | 5.5 grams | 7.0 grams |
| Fluorescent whitener (Whitex 4B, made by Sumitomo Chemical) | 1.0 gram | 2.0 grams |
| Water to make up to | 1000 ml | 1000 ml |
| pH (25° C.) | 10.05 | 10.45 |
| Bleach-Fix Bath (Parent Bath = Replenisher) | | |
| Water | 400 ml | |
| Ammonium thiosulfate | 100 ml | |

-continued

| | |
|---|---|
| Sodium sulfite | 17 grams |
| Ethylenediamine tetra-acetic acid, Fe(III) ammonium salt | 55 grams |
| Ethylenediamine tetra-acetic acid, di-sodium salt | 5 grams |
| Ammonium bromide | 40 grams |
| Water to make up to | 1000 ml |
| pH (25° C.) | 6.0 |
| Rinse Bath (Parent Bath = Replenisher) | |
| Ion exchanged water (Calcium and magnesium both less than 3 ppm) | |

TABLE 7

| Sample No | Details | Anti-color Fading Agent*3 | Additive*1 | Fresh Bath $D_{min}$ | Fresh Bath $D_{max}$ | Fresh Bath Grad. | Running Bath $D_{min}$ | Running Bath $D_{max}$ | Running Bath Grad. |
|---|---|---|---|---|---|---|---|---|---|
| 401 | Comp. Ex. | — | — | 0.12 | 2.49 | 1.67 | 0.12 | 2.48 | 1.62 |
| 402 | Comp. Ex. | — | B-1 | 0.12 | 2.48 | 1.68 | 0.12 | 2.02 | 1.31 |
| 403 | Comp. Ex. | — | B-2 | 0.13 | 2.50 | 1.70 | 0.12 | 2.01 | 1.27 |
| 404 | Comp. Ex. | — | B-3 | 0.12 | 2.51 | 1.72 | 0.13 | 2.03 | 1.30 |
| 405 | Comp. Ex. | *2 | B-1 | 0.12 | 2.51 | 1.71 | 0.12 | 1.92 | 1.28 |
| 406 | Comp. Ex. | — | (1) | 0.11 | 2.49 | 2.11 | 0.12 | 2.49 | 2.08 |
| 407 | Comp. Ex. | — | (2) | 0.10 | 2.51 | 2.21 | 0.12 | 2.51 | 2.18 |
| 408 | Comp. Ex. | — | (4) | 0.11 | 2.50 | 2.23 | 0.11 | 2.50 | 2.20 |
| 409 | Comp. Ex. | — | (9) | 0.10 | 2.51 | 2.19 | 0.10 | 2.50 | 2.15 |
| 410 | Comp. Ex. | — | (12) | 0.10 | 2.49 | 2.18 | 0.10 | 2.48 | 2.21 |
| 411 | Comp. Ex. | — | (20) | 0.10 | 2.50 | 2.21 | 0.11 | 2.50 | 2.17 |
| 422 | Comp. Ex. | — | (22) | 0.10 | 2.51 | 2.21 | 0.10 | 2.49 | 2.16 |
| 423 | Invention | *2 | (1) | 0.10 | 2.48 | 2.21 | 0.11 | 2.45 | 2.15 |
| 424 | Invention | *2 | (2) | 0.11 | 2.50 | 2.23 | 0.11 | 2.48 | 2.18 |
| 425 | Invention | *2 | (4) | 0.11 | 2.50 | 2.18 | 0.11 | 2.49 | 2.10 |
| 426 | Invention | *2 | (9) | 0.11 | 2.51 | 2.21 | 0.11 | 2.49 | 2.19 |
| 427 | Invention | *2 | (22) | 0.10 | 2.49 | 2.23 | 0.11 | 2.47 | 2.21 |
| 428 | Invention | *2 | (24) | 0.11 | 2.50 | 2.20 | 0.11 | 2.49 | 2.19 |
| 429 | Invention | A-1 | (1) | 0.10 | 2.50 | 2.21 | 0.11 | 2.49 | 2.20 |
| 430 | Invention | A-2 | (1) | 0.10 | 2.48 | 2.19 | 0.11 | 2.48 | 2.18 |
| 431 | Invention | A-3 | (2) | 0.11 | 2.49 | 2.19 | 0.11 | 2.49 | 2.19 |
| 432 | Invention | A-10 | (2) | 0.10 | 2.49 | 2.19 | 0.11 | 2.48 | 2.18 |
| 433 | Invention | A-12 | (21) | 0.11 | 2.51 | 2.18 | 0.11 | 2.49 | 2.18 |
| 434 | Invention | A-10 | (22) | 0.11 | 2.50 | 2.20 | 0.11 | 2.49 | 2.19 |
| 435 | Invention | A-10 | (22) | 0.11 | 2.49 | 2.18 | 0.11 | 2.49 | 2.18 |

*1 5.0 mol % with respect to coupler added
*2 An equimolar mixture of anti-color fading agents A-10 and A-17 of this invention.
*3 Equimolar with the coupler.

It is clear from Table 7 that in those cases in which compounds of this invention were used the photographic characteristics were better than those obtained with the comparative compounds, and there was also a pronounced improvement with respect to the change in photographic characteristics in the running test.

It is possible by means of the present invention to obtain silver halide color photographic materials which provide adequate maximum and minimum densities and excellent gradation, and which have markedly improved storage properties.

Furthermore, the above mentioned photographic materials have markedly reduced color mixing and excellent photographic characteristics even when processed in a development bath fatigued by running, and other practical advantages.

While the invention has been described in detail and with reference to specific embodiments thereof, it will be apparent to one skilled in the art that various changes and modifications can be made therein without departing from the spirit and scope thereof.

WHAT IS CLAIMED IS:

1. A silver halide color photographic material comprising a support having thereon at least one silver halide emulsion layer, wherein said photographic material contains at least one compound represented by general formula [I], and at least one compound represented by general formula [II] or an organometallic complex which has copper, cobalt, nickel, palladium or platinum as the central metal and which has at least one bidentate organic ligand, wherein general formula [I]is as follows:

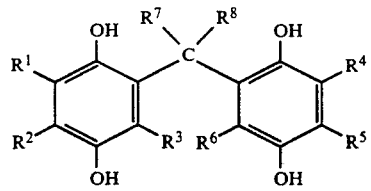

[I]

wherein $R^1$, $R^2$, $R^3$, $R^4$, $R^5$ and $R^6$, which may be the same or different, each represents hydrogen atoms, halogen atoms, sulfo groups, carboxyl groups, cyano groups, alkyl groups, aryl groups, acylamino groups, sulfonamido groups, alkoxy groups, aryloxy groups, alkylthio groups, arylthio groups, acyl groups, acyloxy groups, sulfonyl groups, carbamoyl groups, alkoxycarbonyl groups or sulfamoyl groups, and these may have substituent groups, and $R^1$ and $R^2$, and $R^4$ and $R^5$, may together form a carbocyclic or a heterocyclic ring, $R^7$ represents an alkyl group, an aryl group or an aralkyl group, $R^8$ represents a hydrogen atom or a group the same as $R^7$, and $R^7$ and $R^8$ may together form a carbocyclic or a heterocyclic ring, and general formula (II) is as follows:

$$R_{10}—W—R_{11} \quad [II]$$

wherein $R_{10}$ represents an aliphatic group, an aromatic group or a heterocyclic group, $R_{11}$ represents a hydrogen atom, an aliphatic group, an aromatic group, a heterocyclic group or

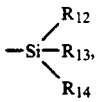

wherein $R_{12}$, $R_{13}$ and $R_{14}$ may be the same or different, each representing an alkyl group, an alkenyl group, an aryl group, an alkoxy group, an alkenoxy group or an aryloxy group, W represents —O—, —S— or

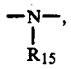

wherein $R_{15}$ represents a hydrogen atom, an aliphatic group, an aromatic group, a heterocyclic group, an acyl group, a sulfonyl group, a sulfinyl group, an oxy radical group or a hydroxyl group, and $R_{10}$ and $R_{11}$ may be joined together to form a five to seven membered ring, and $R_{15}$ and $R_{10}$ or $R_{11}$ may be joined together to form a five to seven membered ring.

2. The silver halide color photographic material as in claim 1, wherein the compound represented by general formula [I] is present in an amount of from about $1\times10^{-8}$ mol/m$^2$ to about $1\times10^{-2}$ mol/m$^2$.

3. The silver halide color photographic material as in claim 1, wherein the compound represented by general formula [I] is present in an amount of from about $1\times10^{-6}$ mol/m$^2$ to about $1\times10^{-4}$ mol/m$^2$.

4. The silver halide color photographic material as in claim 1, wherein the compound represented by general formula [I] is present in an emulsion layer, an intermediate layer, a protective layer or a backing layer.

5. The silver halide color photographic material as in claim 4, wherein the compound represented by general formula [I] is present in an emulsion layer or an intermediate layer adjacent to an emulsion layer.

6. The silver halide color photographic material as in claim 1, wherein the compound represented by general formula [II] is selected from the compounds represented by the following general formulae [II-a], [II-b], [II-c], [II-d], [II-e] and [II-f]:

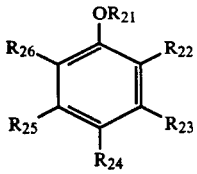

[II-a]

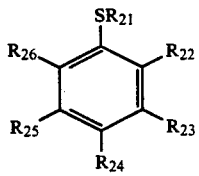

[II-b]

-continued

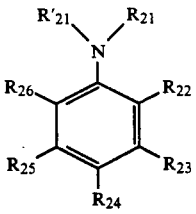

[II-c]

$R_{30}$—O—$R_{31}$ [II-d]

$R_{30}$—S—$R_{31}$ [II-e]

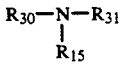

[II-f]

wherein $R_{21}$ represents a hydrogen atom, an aliphatic group, an aromatic group, a heterocyclic group which has one or two hetero atoms in the ring structure, or

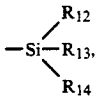

wherein $R_{12}$, $R_{13}$ and $R_{14}$ have the same significance as defined in connection with general formula [II], $R_{22}$–$R_{26}$ may be the same or different, each represents a hydrogen atom, —W—$R_{11}$, an aliphatic group, an aromatic group, a heterocyclic group which has one or two hetero atoms in the ring structure, a diacylamino group, a halogen atom, a sulfonyl group, a sulfinyl group, an alkoxycarbonyl group, an aryloxycarbonyl group, a ureido group, a urethane group, a sulfamoyl group, a carbamoyl group, a cyano group, a nitro group, a carbonyloxy group, a sulfonyloxy group, a silyloxy group or am imido group, wherein —W—$R_{11}$ has the same significance as defined in connection with general formula [II], $R_{21}$ and $R_{22}$ may together form a five to seven membered ring, $R'_{21}$ has the same significance as that defined for $R_{21}$ above provided that $R'_{21}$ is not a silyl group, $R'_{21}$ and $R_{22}$ or $R_{21}$ may together form a five to seven membered ring, $R_{30}$ represents an aliphatic group or a heterocyclic group, $R_{31}$ represents a hydrogen atom, an aliphatic group, or a heterocyclic group, $R_{15}$ has the same significance as that defined in connection with general formula [II], $R_{30}$ and $R_{31}$, $R_{30}$ and $R_{15}$ or $R_{31}$ and $R_{15}$ may together form a five to seven membered ring.

7. The silver halide color photographic material as in claim 6, wherein the compound represented by general formula [II] is the compound represented by general formula [II-a] or [II-b].

8. The silver halide color photographic material as in claim 6, wherein the compound represented by general formula [II] a the mixture of the compounds represented by general formulae [II-a] and [II-b].

9. The silver halide color photographic material as in claim 1, wherein the organometallic complex is selected from the compounds represented by the following general formulae [V-a], [V-b], [V-c] and [V-d]:

[V-a]

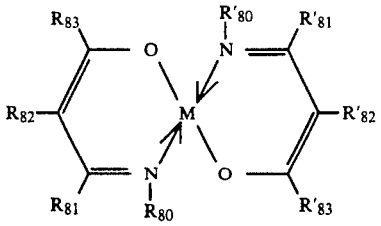

[V-b]

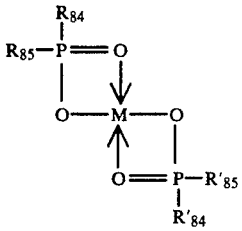

[V-c]

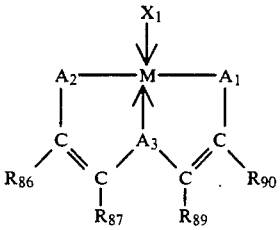

[V-d]

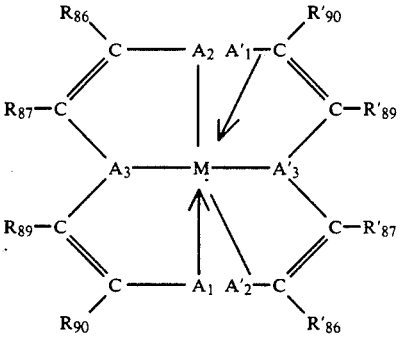

wherein M represents copper, cobalt, nickel, palladium or platinum, $R_{80}$ and $R'_{80}$ may be the same or different, each represents a hydrogen atom, an alkyl group, an aryl group or a hydroxyl group, wherein $R_{80}$ and $R'_{80}$ may be joined together, $R_{81}$, $R_{82}$, $R_{83}$, $R'_{81}$, $R'_{82}$ and $R'_{83}$ may be the same or different, each represents a hydrogen atom, an alkyl group or an aryl group, $R_{82}$ and $R_{83}$, and $R'_{82}$ and $R'_{83}$ may together form an aromatic or five to eight membered ring, $R_{84}$, $R_{85}$, $R'_{84}$ and $R'_{85}$ may be the same or different, each represents an alkyl group, an aryl group, an alkylthio group, an arylthio group, an alkoxy group, an aryloxy group, an alkylamino group or an arylamino group, $R_{86}$–$R_{90}$, $R'_{86}$–$R'_{90}$ may be the same or different, each represents a hydrogen atom, an alkyl group or an aryl group, at least one of the pairs $R_{86}$ and $R_{87}$, $R_{89}$ and $R_{90}$, $R'_{86}$ and $R'_{87}$, or $R'_{89}$ and $R'_{90}$ may together form an aromatic or a five to eight membered ring, $X_1$ represents a compound which can coordinate with M, $A_1$, $A_2$, $A'_1$ and $A'_2$ may be the same or different, each represents an oxygen atom, a sulfur atom, —$NR_{91}$—, a hydroxyl group, an alkoxy group, an alkylthio group or

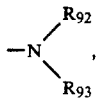

wherein $R_{91}$ represents a hydrogen atom, an alkyl group, an aryl group, a hydroxyl group or an alkoxy group, and $R_{92}$ and $R_{93}$ may be the same or different, each represents a hydrogen atom or an alkyl group, $A_3$ and $A'_3$ represent oxygen atoms, sulfur atoms or —NH— groups.

10. The silver halide color photographic material as in claim 1, wherein the organometallic complex is present in an amount of from about 0.1 mg/m$^2$ to about 10 g/m$^2$.

11. The silver halide color photographic material, as in claim 1, wherein the organometallic complex is present in an emulsion layer, an intermediate layer, a protective layer or a backing layer.

12. The silver halide color photographic material as in claim 1, wherein the photographic material is a direct positive color photographic material.

13. The silver halide color photographic material as in claim 1, wherein the photographic material is a negative color photographic material.

* * * * *